US005829893A

United States Patent [19]

Kinoshita et al.

[11] Patent Number: 5,829,893

[45] Date of Patent: Nov. 3, 1998

[54] PORTABLE PRINTING DEVICE

[75] Inventors: Naohisa Kinoshita; Yoshiki Katayama; Motoaki Yamanashi, all of Nagoya; Masatoshi Kokubo, Aichi-ken, all of Japan

[73] Assignee: Brother Kogyo Kabushiki Kaisha, Aichi-ken, Japan

[21] Appl. No.: 892,967

[22] Filed: Jul. 15, 1997

[30] Foreign Application Priority Data

Jul. 16, 1996 [JP] Japan ..... 8-206615

[51] Int. Cl.[6] ..... B41J 3/39

[52] U.S. Cl. ..... 400/88; 347/109; 400/175; 400/692; 400/693

[58] Field of Search ..... 400/88, 624, 680, 400/691, 692, 693, 175; 346/143; 347/109, 110, 37

[56] References Cited

U.S. PATENT DOCUMENTS

| | | | |
|---|---|---|---|
| 3,656,169 | 4/1972 | Kashio . | |
| 3,767,020 | 10/1973 | Rowe . | |
| 4,168,533 | 9/1979 | Schwartz . | |
| 4,211,012 | 7/1980 | Alles et al. . | |
| 4,611,246 | 9/1986 | Nihei | 346/143 |
| 4,962,430 | 10/1990 | Hiroki et al. | 400/88 |
| 4,999,016 | 3/1991 | Suzuki et al. | 400/88 |
| 5,028,934 | 7/1991 | Kasai et al. | 346/143 |
| 5,236,265 | 8/1993 | Saito et al. | 400/88 |
| 5,308,173 | 5/1994 | Amano et al. | 400/88 |
| 5,593,236 | 1/1997 | Bobry . | |

FOREIGN PATENT DOCUMENTS

| | | |
|---|---|---|
| 1-67052 | 4/1989 | Japan . |
| 2-43059 | 3/1990 | Japan . |

*Primary Examiner*—Ren Yan
*Attorney, Agent, or Firm*—McGinn & Gibb, P.C.

[57] ABSTRACT

A printing device includes a casing housing a sheet-feed mechanism for transporting a print medium and a carriage transporting mechanism for reciprocally moving a carriage in a main scanning direction. A print unit having a print head is detachably attached to the carriage. The print unit is capable of printing whether attached or detached from the carriage. A detection unit is provided for determining whether the print unit is attached to the carriage. The casing can be formed with a hollow space in which the print unit can be stored when the print device is not being used.

24 Claims, 25 Drawing Sheets

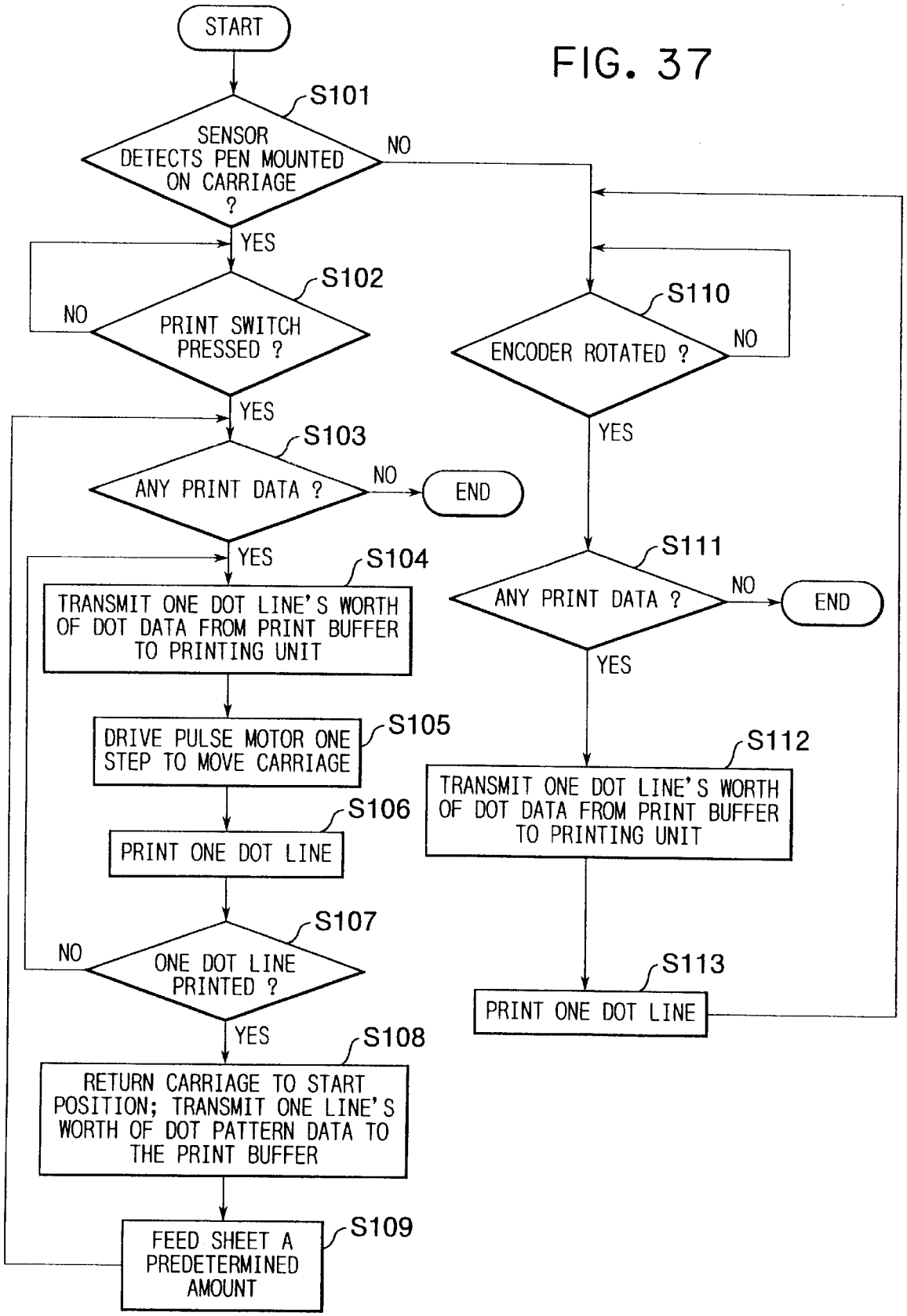
FIG. 37
START
S101
SENSOR DETECTS PEN MOUNTED ON CARRIAGE ?
NO
YES
S102
PRINT SWITCH PRESSED ?
NO
YES
S103
ANY PRINT DATA ?
NO
END
YES
S104
TRANSMIT ONE DOT LINE'S WORTH OF DOT DATA FROM PRINT BUFFER TO PRINTING UNIT
S105
DRIVE PULSE MOTOR ONE STEP TO MOVE CARRIAGE
S106
PRINT ONE DOT LINE
S107
ONE DOT LINE PRINTED ?
NO
YES
S108
RETURN CARRIAGE TO START POSITION; TRANSMIT ONE LINE'S WORTH OF DOT PATTERN DATA TO THE PRINT BUFFER
S109
FEED SHEET A PREDETERMINED AMOUNT
S110
ENCODER ROTATED ?
NO
YES
S111
ANY PRINT DATA ?
NO
END
YES
S112
TRANSMIT ONE DOT LINE'S WORTH OF DOT DATA FROM PRINT BUFFER TO PRINTING UNIT
S113
PRINT ONE DOT LINE

PORTABLE PRINTING DEVICE

BACKGROUND OF THE INVENTION

1. Field of the Invention

The present invention relates to a manual printing unit capable of being attached to a carriage of a carriage movement unit in order to perform automatic printing.

2. Description of the Related Art

Conventionally, there has been known a printing device including a print medium transport means for transporting a print medium, such as a print paper, and a printing means for reciprocally moving, across the print medium according to the size of the print medium, a carriage mounted with a print head. Electrophotographic and ink jet type desktop printing devices are being produced in ever increasingly compact sizes. However, these desktop models lack portability.

Conventionally, there have been proposed various types of compact-sized portable printing devices. The portable printing devices include a body case housing a printing mechanism with a print head formed from a thermal head. Printing is performed on a print medium by holding the body case on the print medium in a substantially upright posture and manually moving the body case in a main scanning direction.

For example, Japanese Laid-Open Utility Model Publication Nos. HEI-1-67052 and HEI-2-43059 describe a handy-type printing devices including a thermal print head and a movement amount detection unit, both housed in a body case. The movement amount detection unit includes a scanning roller which rolls across the print medium and an encoder for detecting amount that the casing moves across the print medium based on rotation of the scanning roller.

With the handy-type printing devices described in Japanese Laid-Open Utility Model Publication Nos. HEI-1-67052 and HEI-2-43059, printing is performed by the user manually scanning the body case across the print medium in a main scanning direction. Therefore, printing can be performed not only on standard-sized print media such as A4 and B5 sized sheets, but also on many other kinds of print media. Also, because the user will not always scan the printing device across the print medium at a uniform speed, the thermal elements aligned on the thermal head are controlled to print dot lines every time the body case is moved by a set pitch, which corresponds to a predetermined resolution, based on the movement amount detected by the movement amount detection unit. In this way, characters and images can be printed clearly on the print medium regardless of whether or not the user scans the casing at a uniform speed.

SUMMARY OF THE INVENTION

However, because the casing is held and moved manually by the user, the printing device will not always be moved in straight lines so that precise printing can not be performed. As a result, this type of printing unit is not well suited to printing over a large printing area.

It is conceivable to produce a compact-sized printing device with a casing that houses a medium feed mechanism for transporting a print medium and a carriage movement mechanism for moving a carriage on which a handy-type printing unit is detachably mounted.

With such a compact-sized printing device, a user can perform manual scanning printing in a manner similar to that described above for the devices of Japanese Laid-Open Utility Model Publication Nos. HEI-1-67052 and HEI-2-43059. First, the user removes the portable printing unit from the carriage and holds it on a print medium in substantially an upright posture. The user then manually moves the printing device in the main scanning direction across the print medium.

Additionally, this conceivable device can be used to perform automatic scanning printing in a manner similar to typical desk type printing device. First, a user mounts the portable printing unit on the carriage. The medium feed mechanism and the carriage movement mechanism are then controlled to generate relative movement in a main and auxiliary scanning directions between the printing unit and the print medium while the print head prints on the print medium.

With this conceivable printing device, wherein a compact-sized printing device is provided with a portable printing unit detachably mounted on a carriage, printing can be performed at a higher resolution than the resolution of the print head by overlapping printed lines in the auxiliary direction. In other words, the printing unit is first scanned across the print medium in a forward direction. Then, the print medium is fed half an entire line width's distance in the auxiliary scanning direction. Afterward, the printing unit is scanned across the print medium in a return direction. Because the print medium was fed only half an entire lines width's distance for each scan, each line will be printed twice, so that printing can be performed at twice the resolution of the print head.

On the other hand, when printing is performed by manual scanning, a user is unable to move the casing in the auxiliary scanning direction accurately enough to perform this type of overlapping reciprocal printing. As a result, the print resolution in the auxiliary scanning direction will be reduced compared to automatic printing, which would result in a drop in the print density.

It is an objective of the present invention to provide a printing device capable of printing images with high resolution and print density during both automatic printing and manual printing.

In order to achieve the above-described objectives, a printing device according to the present invention includes: a relative movement unit including a carriage, the relative movement unit generating relative movement between the carriage and the print medium in a main scanning direction and in an auxiliary scanning direction perpendicular to the main scanning direction; a printing unit detachably attached to the carriage and having a print head capable of printing dot patterns on the print medium while the printing unit is attached to the carriage and while the printing unit is detached from the carriage; and a detection unit for detecting whether the printing unit is attached to the carriage.

With this configuration, when printing is performed while the printing unit is mounted on the carriage, because the relative movement unit moves the carriage, and consequently the printing unit, in a main scanning direction substantially perpendicular to the medium-feed direction, dot patterns are printed at a print timing based on movement amount of the carriage by the carriage movement unit. On the other hand, when printing is performed by manually moving the printing unit, because dot patterns are printed based on relative movement amount of the printing unit with respect to the print medium, print timing varies and is not a fixed value. In this way, conditions differ between automatic printing and manual printing. However, by using the detection unit to detect whether or not the printing unit is mounted on the carriage, the print timing can be changed between printing with the printing unit mounted on the carriage and printing by manual scanning.

According to another aspect of the present invention, the printing device is put into an automatic scan mode when the detection unit detects that the printing unit is mounted on the carriage and into a manual scan mode when the detection unit detects that the printing unit is not mounted on the carriage. Further, a print timing control unit is provided that controls print timing of the printing unit to print in the main scanning direction at a print resolution that depends on whether the printing device is in the automatic scanning mode or the manual scanning mode.

With this configuration, based on a detection result from the detection unit, the print timing control unit controls the print timing according to the automatic scanning mode, wherein the printing unit is mounted on the carriage, and the manual scanning mode, wherein the printing unit is not mounted on the carriage. Therefore, the print resolution in the main scanning direction can be set to different values between the manual scanning mode and the automatic scanning mode.

According to another aspect of the present invention, the print timing control unit controls print timing of the printing unit to print in the main scanning direction at a higher print resolution in the manual scanning mode than in the automatic scanning mode. With this configuration, the print timing control unit controls the print timing so as to increase the print resolution in the main scanning direction during the manual scanning mode higher than the print resolution during in the automatic scanning mode. Therefore, printing can also be performed at a high print resolution in the manual scanning mode, thereby preventing reduction in print density.

According to another aspect of the present invention, the printing unit is provided with a print timing detection encoder having a maximum encoder resolution, and the print timing control unit controls print timing of the printing unit to print in the main scanning direction at the maximum encoder resolution during the manual scanning mode. With this configuration, the print resolution in the main scanning direction during the manual scanning mode can be easily changed by changing the maximum resolution of the print timing detection encoder.

According to another aspect of the present invention, the print timing control unit controls print timing of the printing unit to print in the main scanning direction at a print resolution two times higher during the manual scanning mode than during the automatic scanning mode. With this configuration, print resolution in the manual scanning mode is double the print resolution in the automatic scanning mode. Therefore, when the print resolution in the auxiliary scanning direction is reduced in the manual scanning mode, the amount of printing material, such as ink, to be impinged on the print sheet in the main scanning direction can be doubled so that reduction in print density can be reliably prevented.

According to another aspect of the present invention, a voltage switching unit is further provided that switches drive voltage supplied to the print head to a higher drive voltage when the printing device is in the manual scan mode than when the printing device is in the automatic scan mode. With this configuration, the voltage switching unit increases drive voltage supplied to the print head to a higher voltage in the manual scanning mode than in the automatic scanning mode. Therefore, in the manual scanning mode, when the print resolution in the auxiliary scanning direction is reduced, ink amount of the dot pattern to be printed on the print medium is increased, thereby increasing print density.

According to another aspect of the present invention, a control unit is provided that, when the printing device is in the automatic scan mode, controls the print medium feed unit in synchronization with the carriage transport unit and the printing unit to increase print resolution in the auxiliary scanning direction. With this configuration, in the automatic scanning mode, the control unit can, for example, control the carriage transport unit and the printing unit in synchronization with the print medium transport unit so that print unit is scanned across the print medium a plurality of times each time the print medium is transported in the auxiliary scanning direction by a predetermined minute amount, thereby enhancing the print resolution in the auxiliary scanning direction.

A printing device according to another aspect of the present invention includes: a print medium feed unit that feeds the print medium in an auxiliary scanning direction; a carriage transport unit having a carriage and that reciprocally moves the carriage in a main scanning direction perpendicular to the auxiliary scanning direction; a printing unit having a print head detachably mountable to the carriage and capable of printing on the print medium; and a casing that houses the print medium feed unit and the carriage transport unit, the casing formed with a hollow portion extending in a movement path of the carriage to a size capable of housing the printing unit.

With this configuration, the printing unit can be stored in the casing in the hollow space formed following the movement pathway of the carriage. When the printing unit is mounted on the carriage, by reciprocally moving the carriage using the carriage transport unit, the printing unit can perform excellent printing on the print medium transported by the print medium transport unit.

According to another aspect of the present invention, the casing is formed with an opening portion following the carriage movement path. Further, a detachable lid is provided to detachably cover the opening, the lid being formed with a support portion detachably supporting the printing unit. With this configuration, the printing unit is supported by the support portion of the lid so that the printing unit can be easily attached and detached.

According to another aspect of the present invention, the carriage transport unit includes: a drive pulley and a follower pulley disposed separated by a predetermined distance in the main scanning direction; and a belt fixed at a portion thereof to the carriage and wrapped around the drive pulley and the follower pulley; wherein the hollow portion of the casing extends in the main scanning direction with the belt. With this configuration, the belt reciprocally moves the carriage. Moreover, the hollow space formed following the belt can be effectively used.

According to another aspect of the present invention, the casing includes a first and second members connected foldable between a folded condition and a linear condition. With this configuration, by folding the casing, the portable printing device can be assembled into a shape convenient for being carried.

According to another aspect of the present invention, the printing unit includes a transmission portion for receiving print data from an external device. With this configuration, by merely scanning the printing unit after the transmission portion of the printing unit receives print data from the external device, the printing portion can perform printing on the print medium based on the print data.

BRIEF DESCRIPTION OF THE DRAWINGS

The above and other objects, features and advantages of the invention will become more apparent from reading the following description of the preferred embodiment taken in connection with the accompanying drawings in which:

FIG. 7 is a detail of FIG. 3 showing the left end of the print device a

FIG. 19(*b*) is a schematic view showing a dot pattern produced by a second scan of the printing unit in a reciprocal return direction during the automatic scanning mode;

FIG. 37 is a flowchart representing a routine performed by the control system shown in FIG. 33.

DETAILED DESCRIPTION OF THE PREFERRED EMBODIMENTS

Figure 1:
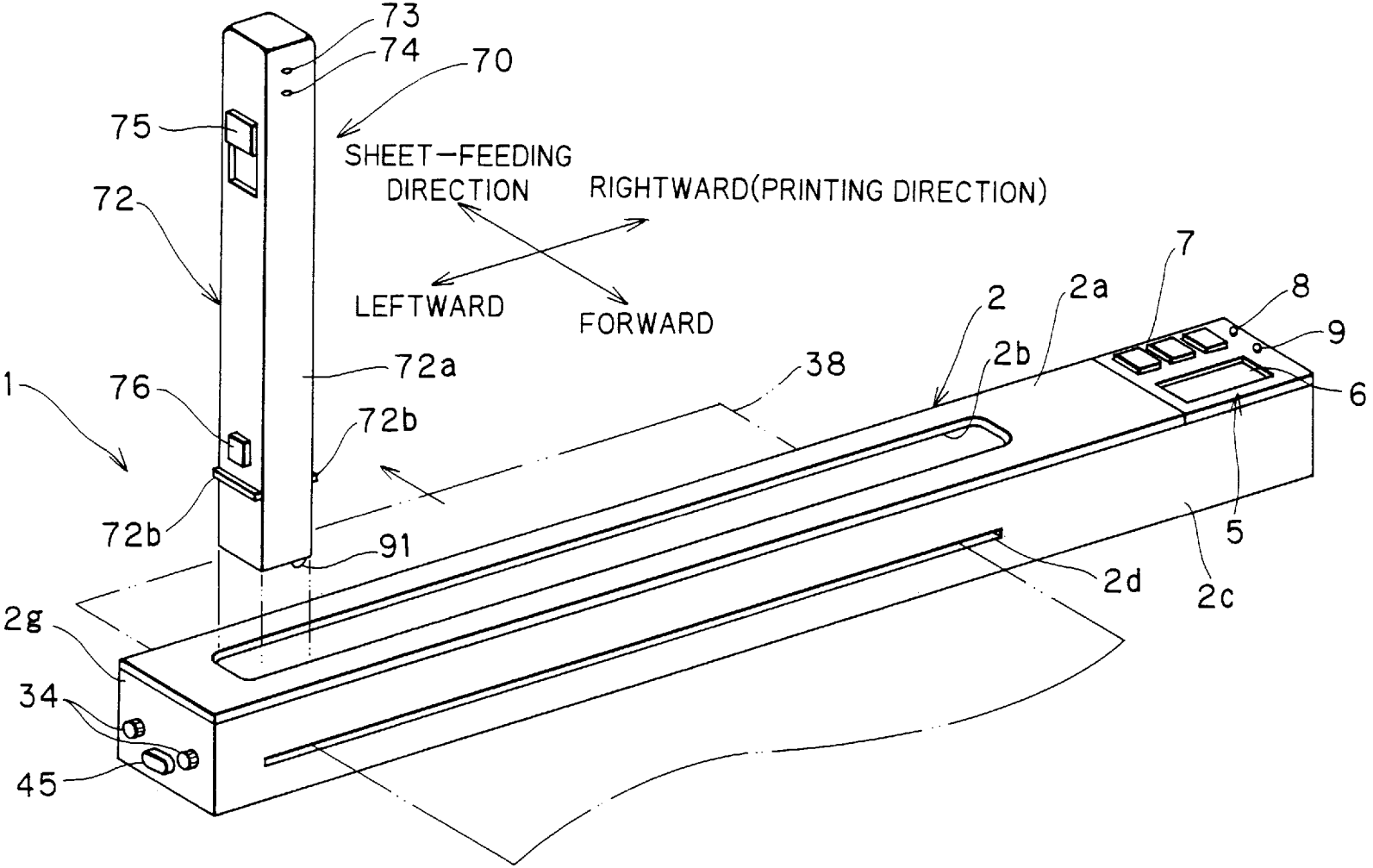
FIG. 1 is a perspective view showing a print device according to a first embodiment of the present invention.

A printing device according to preferred embodiments of the present invention will be described while referring to the accompanying drawings wherein like parts and components are designated by the same reference numerals to avoid duplicating description.

The following embodiments describe the present invention applied to a small printing device on which a handy type printing unit having an ink jet type printing mechanism is detachably mounted to perform printing on print medium.

As shown in FIG. 1, a small printing device 1 includes: a cylindrical casing 2 extending leftward and rightward in FIG. 1 and having a rectangular shape in cross section; a carriage movement mechanism 10 for reciprocally moving a carriage 21 in a main scanning direction across a print sheet 38; a sheet-feed mechanism 30 for transporting the print sheet 38 in a sheet-feed direction, that is, an auxiliary scanning direction, which is perpendicular to the main scanning direction; and a printing unit 70 detachably mounted on the carriage 21.

The casing 2 has lid member 2*a* formed with a rectangular-shaped opening portion 2*b* through which the printing unit 70 can be inserted from above and be transported in the main scanning direction by the carriage movement mechanism 10. Further, an operation panel 5 is disposed at the right edge portion of the lid member 2*a*. The operation panel 5 includes: a liquid crystal display 6 for displaying various messages; a variety of switches 7 such as a power switch and an automatic printing start switch; and an infrared photo diode 8 and an infrared light-emitting diode 9 both for performing optical transmission with the printing unit 70 using infrared light. Also, slits 2*d* through which the print sheet 38 is inserted are formed on a front surface wall portion 2*c* and a back surface wall portion 2*e* of the casing 2.

First, an explanation for the carriage movement mechanism 10 housed in the casing 2 will be provided based on FIGS. 2 through 9.

A drive pulley 11 is rotatably supported on a support shaft 12 near the operation panel 5 at the right end in the casing 2. A follower pulley 15 is rotatably supported by a support shaft 14, which is supported by a pulley supporting clasp 13, at the left edge in the casing 2. A timing belt 16 spans between the drive pulley 11 and the follower pulley 15. A compression coil spring 17 resiliently urges the pulley supporting clasp 13 leftward, thereby applying tension to the timing belt 16.

A carriage drive motor 19 formed from a step motor is disposed near the right-hand end of the casing 2. A drive gear 20 is fixed to a drive shaft 19*a* of the carriage drive motor 19. A middle gear 18 fixed to a support shaft 12 meshingly engages with the drive gear 20.

Figure 9:
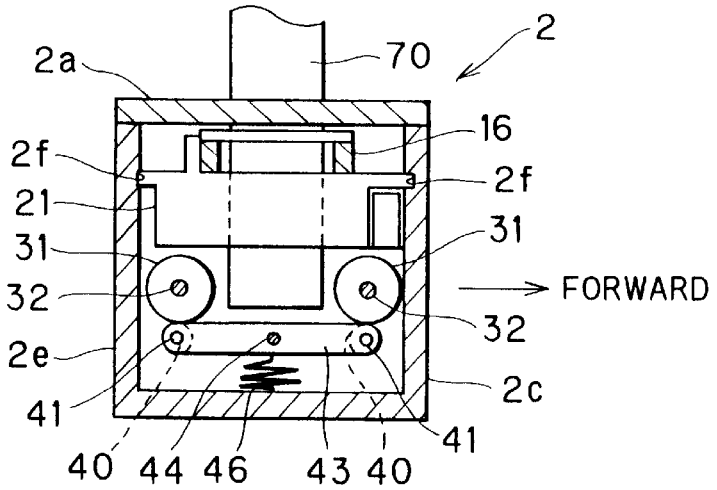
FIG. 9 is a cross-sectional view taken along line IX—IX of FIG. 7.

On the other hand, as shown in FIG. 9, guide grooves 2f extending leftward and rightward in parallel with each other are formed on the front surface wall portion 2*c* and on the back surface wall portion 2*e* of the casing 2. The guide grooves 2*f* engage with engagement portions of the carriage 21 and guide the carriage 21 to move freely leftward and rightward. One portion of the timing belt 16 is fixed to the carriage 21. As can best be seen in FIG. 6, pressing pulleys 22 are provided for preventing the timing belt 16 from detaching from the drive pulley 11 and the follower pulley 15.

With this configuration, rotation of the carriage drive motor 19 moves the carriage 21 reciprocally leftward and rightward via the gears 18, 20, the pulleys 11, 15, and the timing belt 16.

Figure 2:
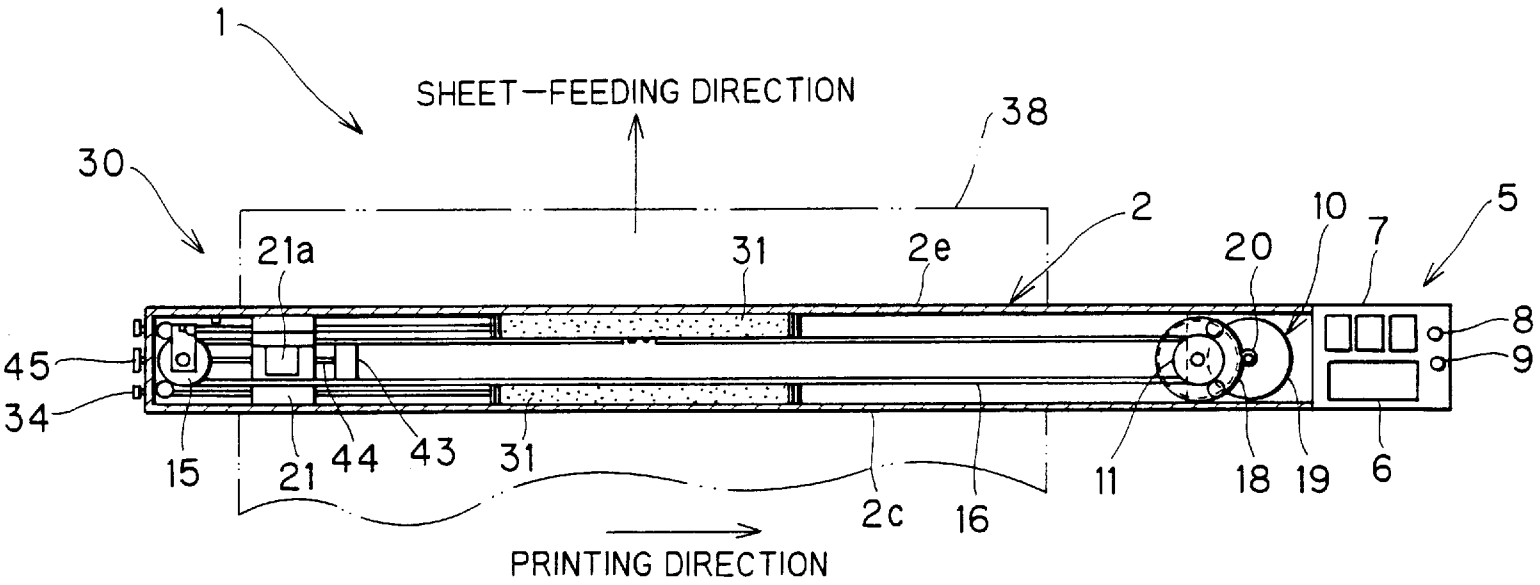
FIG. 2 is a plan view in partial cross-section showing components housed in a casing of the print device of FIG. 1.

As shown in FIG. 2, an opening portion 21*a* for mounting the printing unit 70 is formed in the carriage 21. As shown in FIG. 1, protrusion portions 72*b* are formed on left and right sides on the body case 72 of the printing unit 70. When the printing unit 70 is held in a substantially upright posture, inserted by its lower end portion through the opening portion 21*a*, and then pressed downward, the protrusion portion 72*b* are held on the upper edge of the carriage 21 so that the printing unit 70 is mounted and supported on the carriage 21.

Next, an explanation for the sheet-feed mechanism 30 housed in the casing 2 will be provided based on FIGS. 2 through 9.

Drive shafts 32 extending leftward and rightward in parallel with each other are rotatably supported at a plurality of positions by supporting clasps 33. A pair of front and rear side transport rollers 31 having a predetermined length are disposed on the drive shafts 32. The transport rollers 31 extend leftward and rightward in parallel with each other at a position in the casing 2 near a substantially center portion in the lengthwise direction of the slits 2*d*. Left tips of the pair of drive shafts 32 protrude from the casing 2. Operation knobs 34 for manually rotating the transport roller 31 are attached to the left tips of the drive shafts 32.

Figure 7:
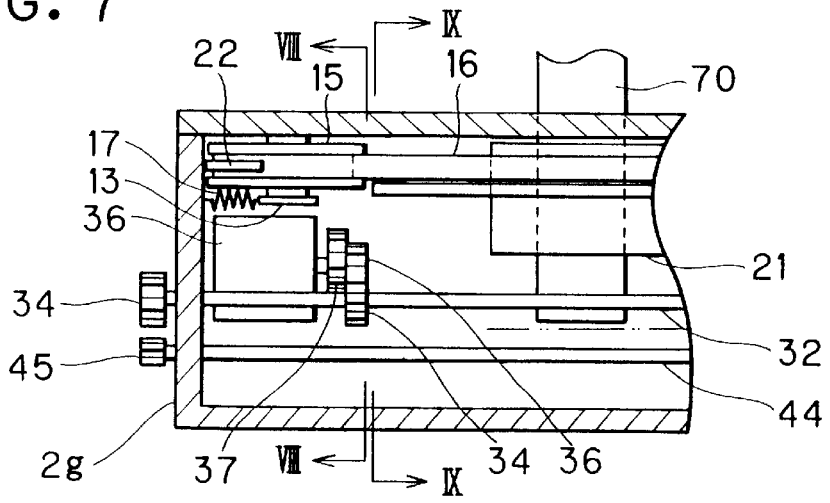
Figure 8:
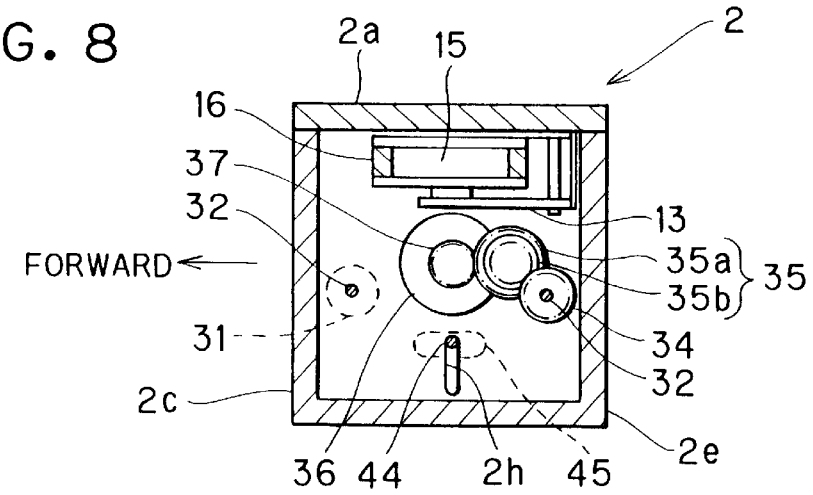
FIG. 8 is a cross-sectional view taken along line VIII—VIII of FIG. 7.

As best seen in FIGS. 7 and 8, a sheet-supply motor 36 having a drive shaft fixed with a drive gear 37 is provided near the left-hand end of the casing 2. A two-step gear 35 (35*a*, 35*b*) is provided in meshing engagement with the drive gear 37. A gear 34 in meshing engagement with two-step gear 35 is provided near the rear side of one of the drive shafts 32. Although not shown in the drawings, gears are also provided for transmitting rotation of the drive gear 37 to the other one of the drive shafts.

Figure 3:
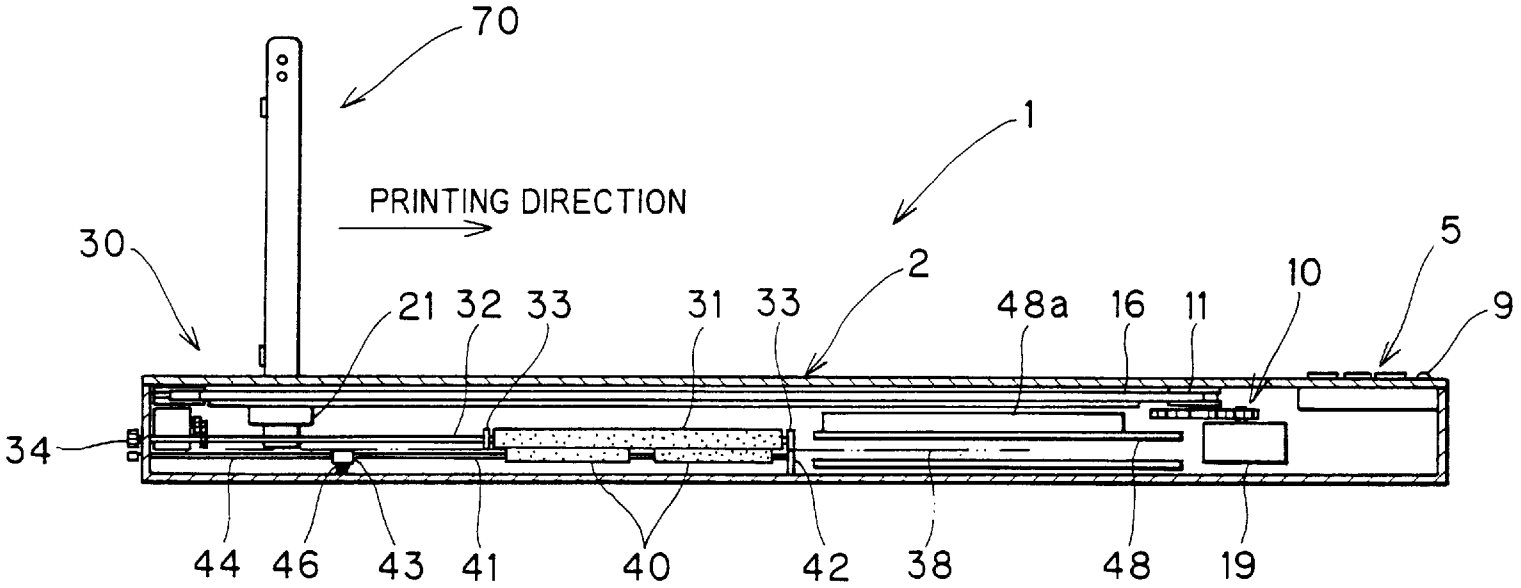
FIG. 3 is a cross-sectional side view showing the print device of FIG. 1.
Figure 4:
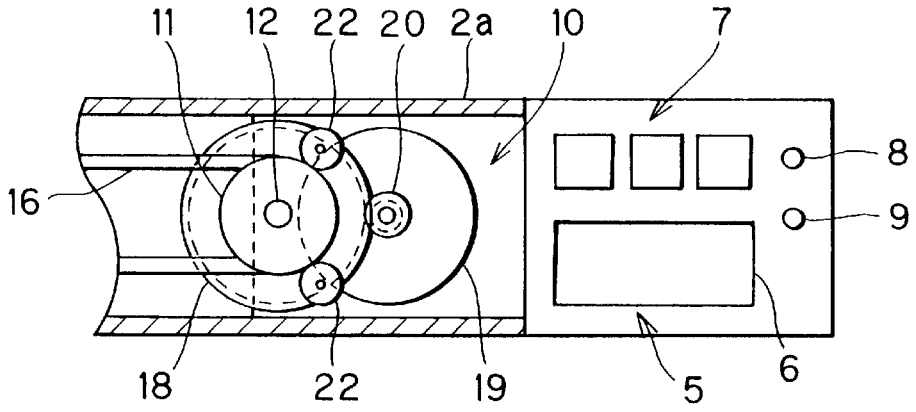
FIG. 4 is a detail of FIG. 2 showing a right end of the print device as viewed in FIG. 2.
Figure 5:
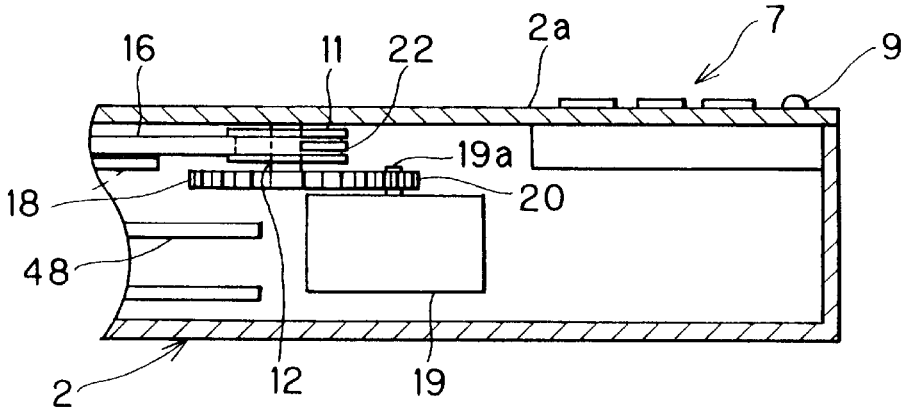
FIG. 5 is a detail of FIG. 3 showing the right end of the print device as viewed in FIG. 3.
Figure 6:
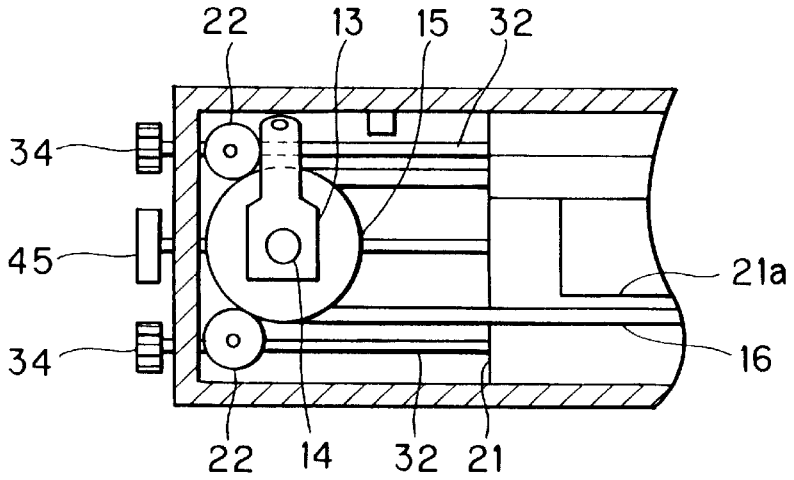
FIG. 6 is a detail of FIG. 2 showing the left end of the print device as viewed in FIG. 2.

On the other hand, as shown in FIG. 3, support shafts 41 are disposed extending leftward and rightward in parallel with each other and with the drive shafts 32. Each of the support shafts 41 is, at its right edge portion, rotatably supported by support clasps 42, and, at its left edge portion, rotatably supported on a connecting member 43 disposed to extend frontward and rearward. A pair of subrollers 40 extending in parallel with the transport rollers 31 are disposed on the support shafts 41 so as to abut the lower sides of the transport rollers 31.

As shown in FIGS. 2 and 7 to 9, a connecting shaft 44 is fixed at its right end to a connecting member 43 for linking vertical movement of the support shafts 41, and consequently of the subrollers 40. The connecting shaft 44 extends leftward so that its left end protrudes through a support hole 2*h* formed on a left side wall portion 2*g* of the casing 2. A press-down knob 45 is attached to the tip of the connecting shaft 44. A compression coil spring 46 resiliently urges the connecting member 43 upward so that the subrollers 40 pressingly urges against the lower side of the transport rollers 31.

With this configuration, when the sheet-supply motor 36 rotates in a predetermined direction, the transport rollers 31 rotate simultaneously with rotation of the drive shafts 32 via the drive gear 37, two-step gear 35, and the gear 34 so that the print sheet 38, which is supplied between the transport rollers 31 and the subrollers 40, can be transported in the sheet-feed direction. At this time, if the print sheet 38 is fed incorrectly at an angle or so as to fold up, the condition of the print sheet 38 can be corrected by pressing the press-down knob 45 downward to separate the subrollers 40 from the transport rollers 31.

Figure 10:
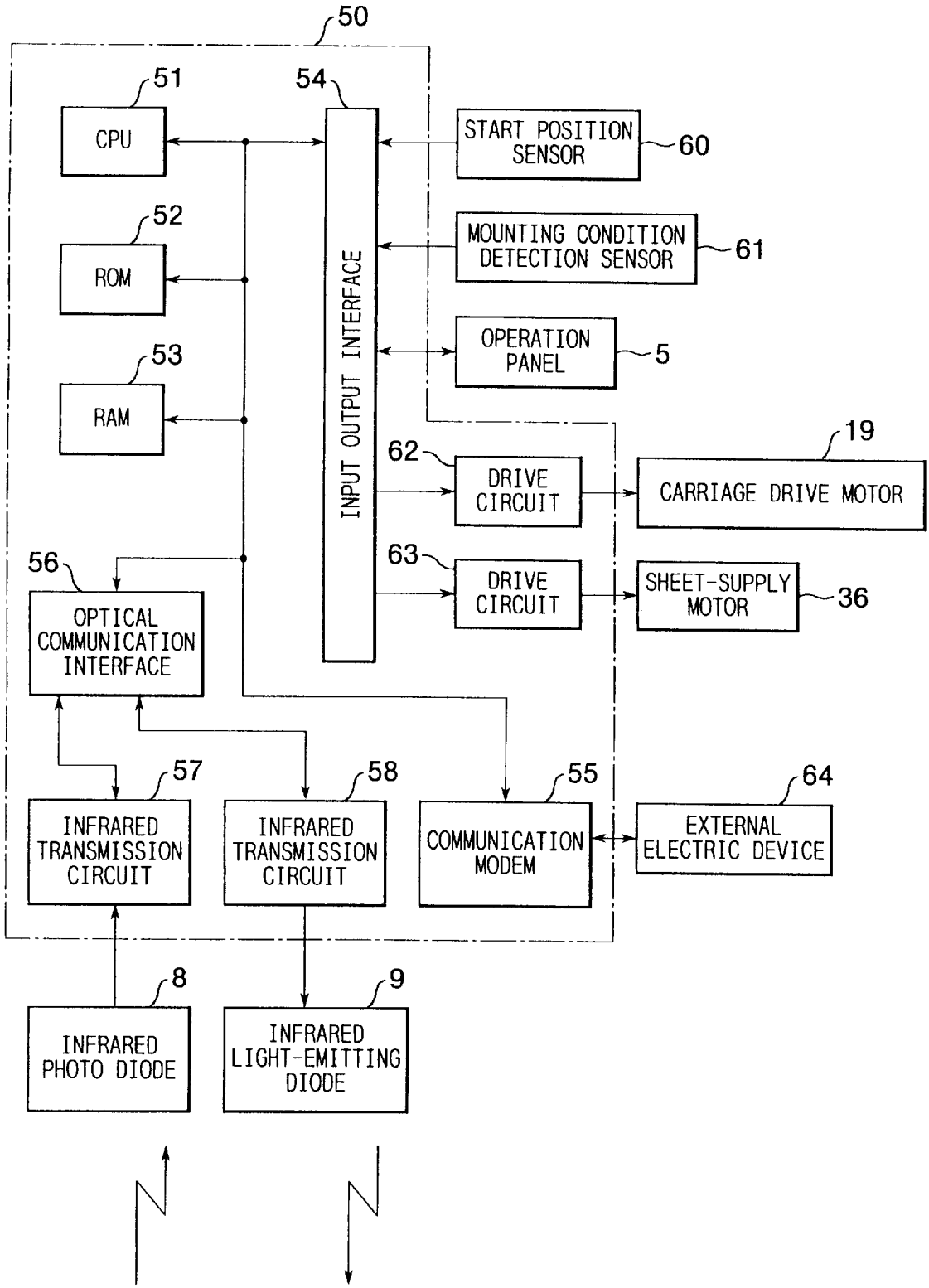
FIG. 10 is a block diagram showing a control system housed in the casing of the print device.

A control board 48 with a control portion 48*a* is housed in the casing 2. A control system of the printing device 1 formed in the control portion 48*a* is configured as shown in a block diagram of FIG. 10. The control system includes a control unit 50, formed from: a microprocessor including a CPU 51, a ROM 52, a RAM 53, an input/output interface 54; a transmission modem 55 for transmitting and receiving transmission data, such as control signals or print data, between an external electric device 64, such as a personal computer; an optical transmission interface 56 using infrared light to communicate with a printing unit 70 to be described later; and other components, such as an infrared reception circuit 57, and an infrared transmission circuit 58, which are connected to the optical transmission interface 56.

Various components are connected to the input/output interface 54, including: a start position sensor 60 for setting a start position of the carriage 21; a mounting condition detection sensor 61, disposed on the carriage 21, for detecting if the printing unit 70 is mounted on the carriage 21; an operation panel 5; a drive circuit 62 for driving the carriage drive motor 19; and a drive circuit 63 for driving the sheet-supply motor 36. The infrared photo diode 8 is connected to the infrared reception circuit 57. The infrared transmission circuit 58 is connected to the infrared light-emitting diode 9. When the printing unit 70 is mounted, the mounting condition detection sensor 61 outputs a H-level mounting signal SS.

The ROM 52 stores: a drive control program for driving the carriage drive motor 19 or the sheet-supply motor 36; and a control program for controlling printing operations to be described later, by using infrared light to transmit and receive various types of transmission data, such as print data, and controlling the printing unit 70 accordingly. The RAM 53 has a data memory storing the print data received from the external electric device 64 and also a variety of memories necessary to control printing and optical transmission of data.

Next, the printing unit 70 detachably mounted on the carriage 21 will be explained while referring to FIGS. 11 to 14.

The printing unit 70 includes a compact body case 72 housing a variety of electrically connected components, including: a printing mechanism 80 having a print head 82; a movement amount detecting mechanism 90; an infrared photo diode 73 and an infrared light-emitting diode 74 for performing optical transmission using infrared light; a control board 77 having a control portion 77*a* for controlling transmission and reception of the photo diodes 73, 74 and also for controlling drive of the printing mechanism 80 based on an encoder signal received from the movement amount detecting mechanism 90; and a battery 78 serving as a power source. The printing unit 70 can print characters or images on the print sheet 38 by ejecting ink from the print head 82.

Figure 11:
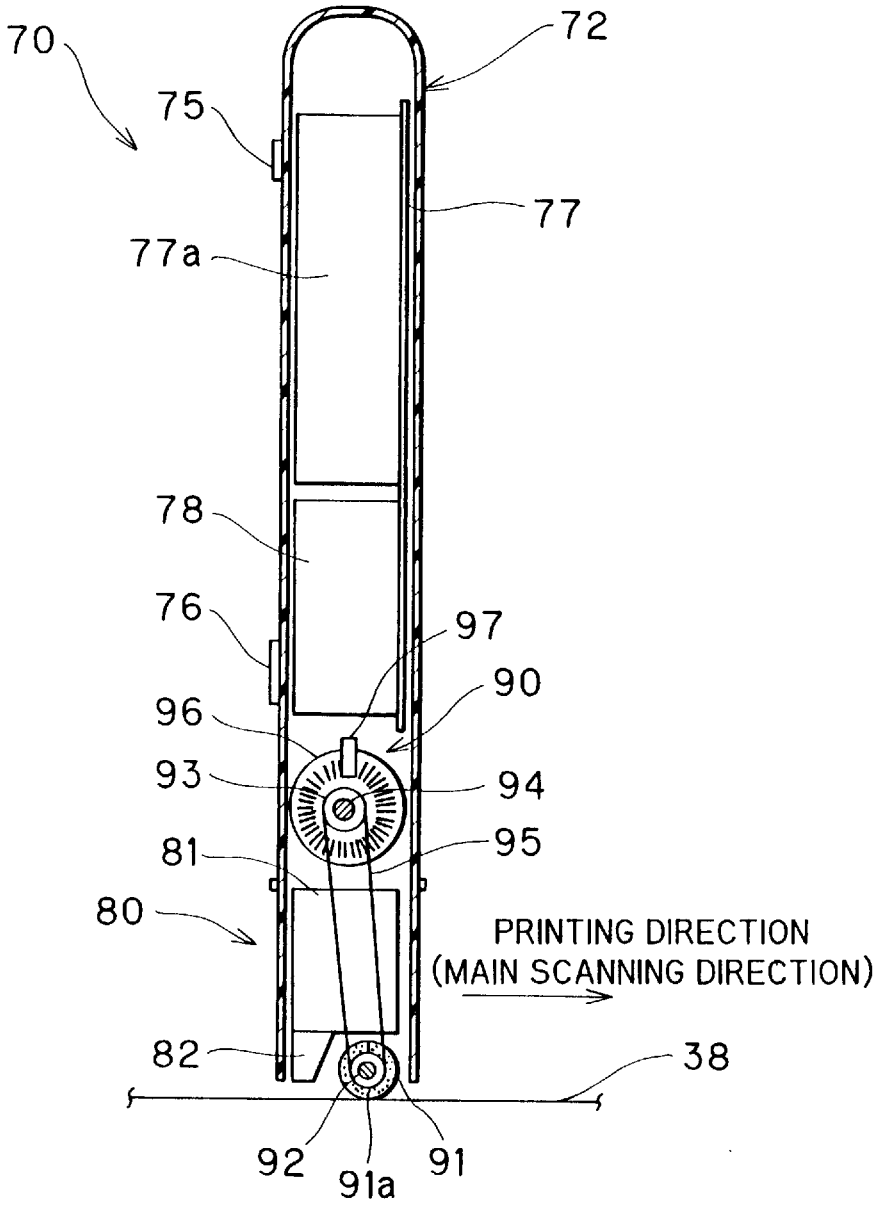
FIG. 11 is a cross-sectional side view showing a printing unit of the print device of the first embodiment.

As viewed in FIG. 11, the body case 72 is a hollow compound resin case having a substantially rectangular shape in cross-section when viewed from above and formed with an opening on its bottom portion. The infrared photo diode 73, the infrared light-emitting diode 74, and a power source knob 75 for activating a power source switch 75*a* are provided near the upper end of a front surface wall 72*a* of the body case 72. A print start button 76 for activating a print start switch 76*a* to start printing is provided near the lower end on the front surface wall 72*a*.

Figure 13:
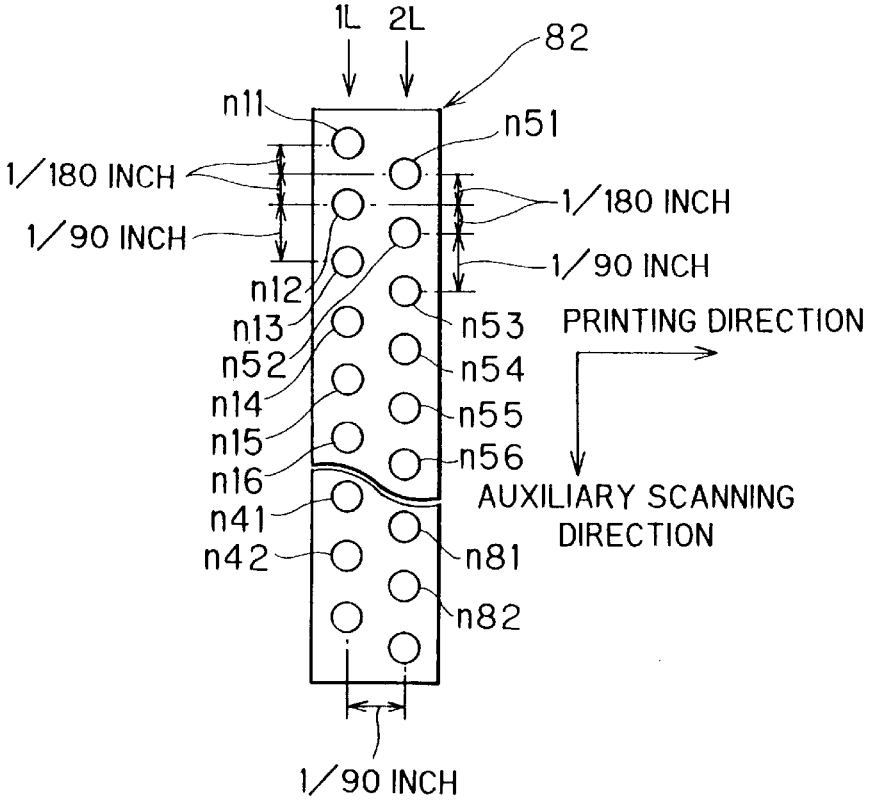
FIG. 13 is a schematic view showing arrangement of nozzles in a print head of the printing unit.

Next, an explanation will be provided for the printing mechanism 80. As shown in FIG. 11, the print head 82 is provided to the lower edge portion of the body case 72. The print head 82 is positioned so that its lower edge is substantially flush with the lower edge of the body case 72. As shown in FIG. 13, 64 ejecting nozzles n, facing downward, are aligned 32 each in two columns 1L and 2L extending in an auxiliary scanning direction perpendicular to the main scanning direction. Adjacent, that is in the auxiliary scanning direction, ejecting nozzles nil through n42 of the first column 1L and n51 through n82 of the second column 2L are separated in the auxiliary scanning direction by a distance of 1/90 inches. Ejecting nozzles n51 through n82 of the second column 2L are shifted from ejecting nozzles n11 through n42 of the first column 1L in the auxiliary scanning direction by 1/180 inches.

An ink tank 81 including an ink absorbent member is detachably provided to the lower end of the body case 72. The print head 82 is connected to the ink tank 81 so that ink in the ink tank 81 is supplied to each ejecting nozzle n11s through n42 of the first column 1L and to each ejecting nozzle n51 through n82 of the second column 2L formed on the print head 82.

Next, the movement amount detecting mechanism 90 for detecting an amount of relative movement between the printing unit 70 and the print sheet 38 will be explained.

Figure 12:
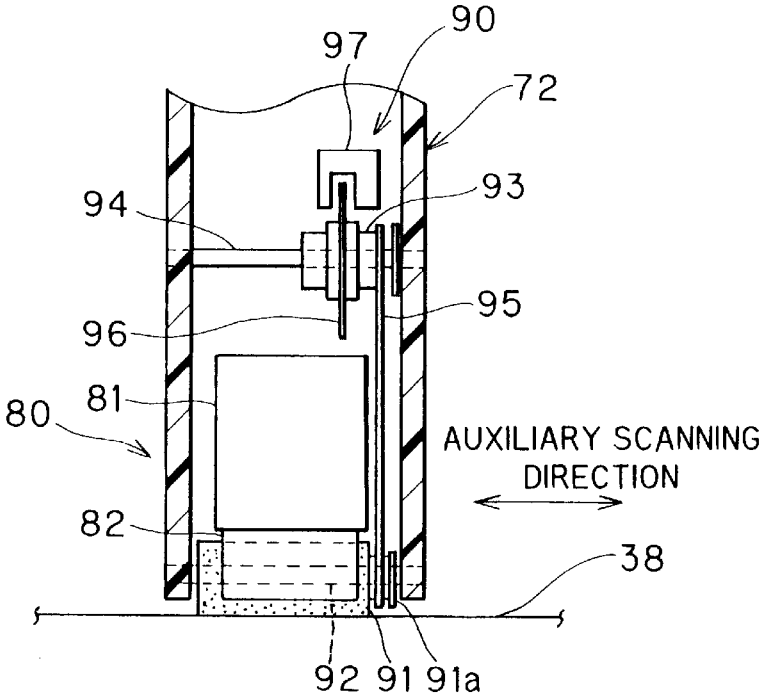
FIG. 12 is a detail from FIG. 11 showing the lower portion of the printing unit as viewed in FIG. 11.

As shown in FIG. 12, a support shaft 92 is provided to the lower end of the body case 72 near the print head 82 so as to extend in the auxiliary scanning direction. The support shaft 92 rotatably supports a timing roller 91, which also extends in the auxiliary scanning direction. An annular-shaped follower wheel 93 is rotatably supported above the ink tank 81 by a support shaft 92. A timing belt 95 spans between the annular-shaped follower wheel 93 and an annular-shaped pulley portion 91*a* of the timing roller 91.

Further, a disk-shaped encoder plate 96 formed with a plurality of slits on its outer periphery is fixed to the follower wheel 93. A photosensor 97 having a light-emitting portion and a light-receiving portion is provided so as to sandwich the outer periphery of the encoder plate 96. The lower edge portion of the timing roller 91 protrudes lower than the lower edge of the body case 72.

To print manually, a user removes the printing unit 70 from the carriage 21 and places the body case 72 on a print sheet 38 while maintaining the body case 72 in substantially an upright posture. Then, the user manually moves the body case 72 in the main scanning direction while maintaining contact between the timing roller 91 and the print sheet 38. As a result, the encoder plate 96 rotates via the timing belt 95 simultaneously with the timing roller 91 rotating in a predetermined direction, that is, the clockwise direction as viewed in FIG. 11.

At this time, based on the encoder signal and the print data formed from pulse trains outputted from the photosensor 97, the two lines of ejecting nozzles n selectively eject ink at a print timing set by each movement of the body case 72 by a predetermined print pitch. In this way, characters and images are printed on the print sheet 38. When printing is performed by manually scanning the printing unit 70 in the main scanning direction, characters and images can be printed at a print resolution of 720 DPI, which is the maximum resolution of the encoder signal outputted by the photosensor 97 using the encoder plate 96.

Figure 14:
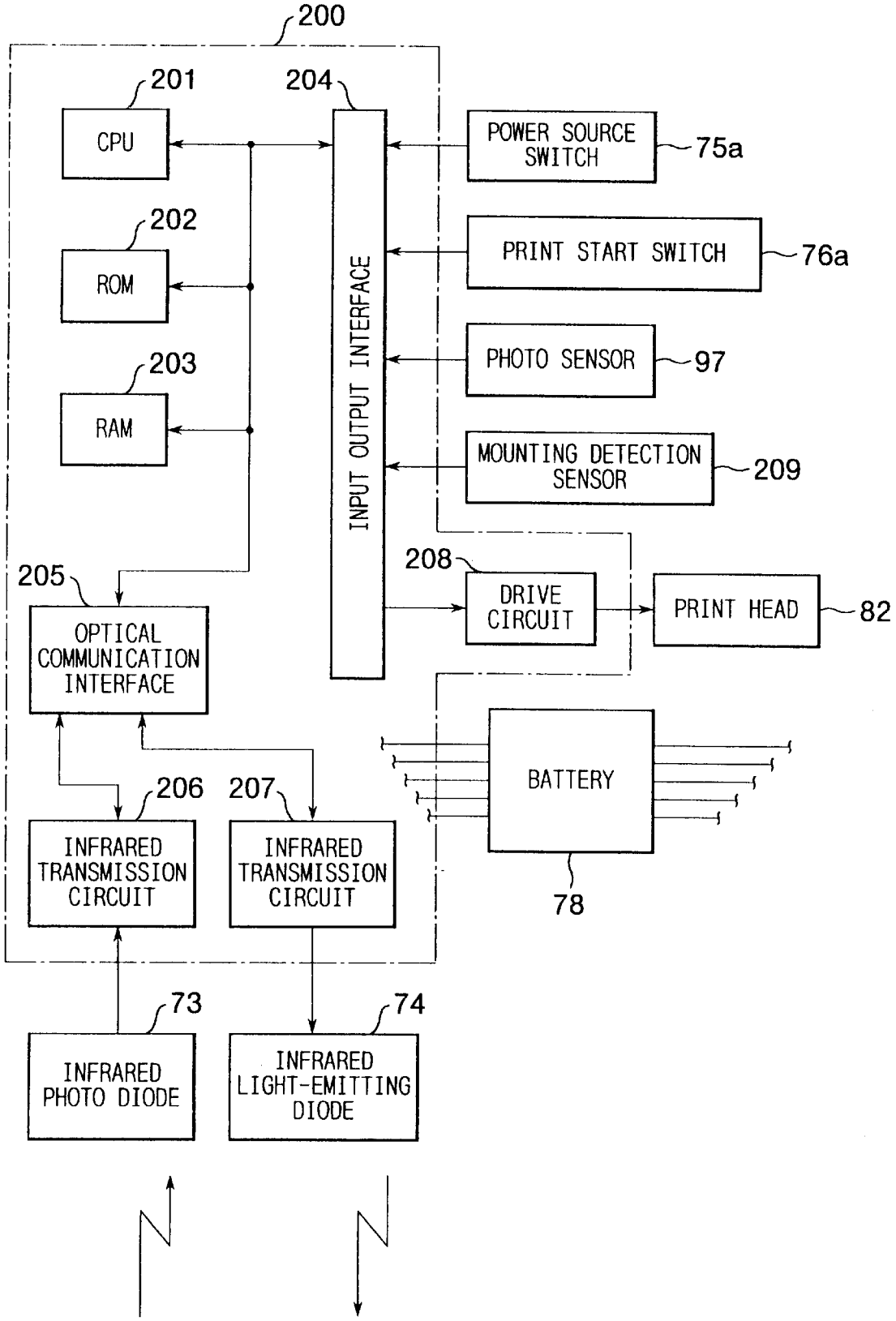
FIG. 14 is a block diagram showing a control system of the printing unit.

Next, while referring to the block diagram of FIG. 14, an explanation will be provided for a control unit 200 provided to the printing unit 70.

The control unit 200 includes: a microprocessor including a CPU 201, a ROM 202, a RAM 203, and an input/output interface 204; and components, such as an optical transmission interface 205, an infrared light reception circuit 206, and an infrared light transmission circuit 207, for transmitting with the printing device 1 using infrared light.

The input/output interface 204 is connected to: the power source switch 75*a*; the print start switch 76*a*; the photosensor 97; a mounting detection sensor 209 for detecting if the printing unit 70 is mounted on the carriage 21; and a drive circuit 208 for driving the print head 82. The infrared photo diode 73 is connected to the infrared light reception circuit 206. The infrared light-emitting diode 74 is connected to the infrared light transmission circuit 207. The infrared light reception circuit 206 is for receiving optical data transmitted from the printing device 1 using infrared light via the infrared photo diode 73. The infrared light transmission circuit 207 is for transmitting, as optical data, data relating to print format, such as a size or font of characters, or to transmission of data to the printing device 1 via the infrared light-emitting diode 74.

The ROM 202 stores: a print control program for controlling drive of an actuator provided to each ejecting nozzle n of the print head 82; a transmission/reception control program controlling transmission of optical data; a control program for a printing process routine to be described later; and dot pattern data for each of a plurality of characters and symbols. The RAM 203 is provided with a data memory storing optical data received from the printing device 1, and also a variety of memories necessary for controlling printing or optical transmission.

Figure 15:
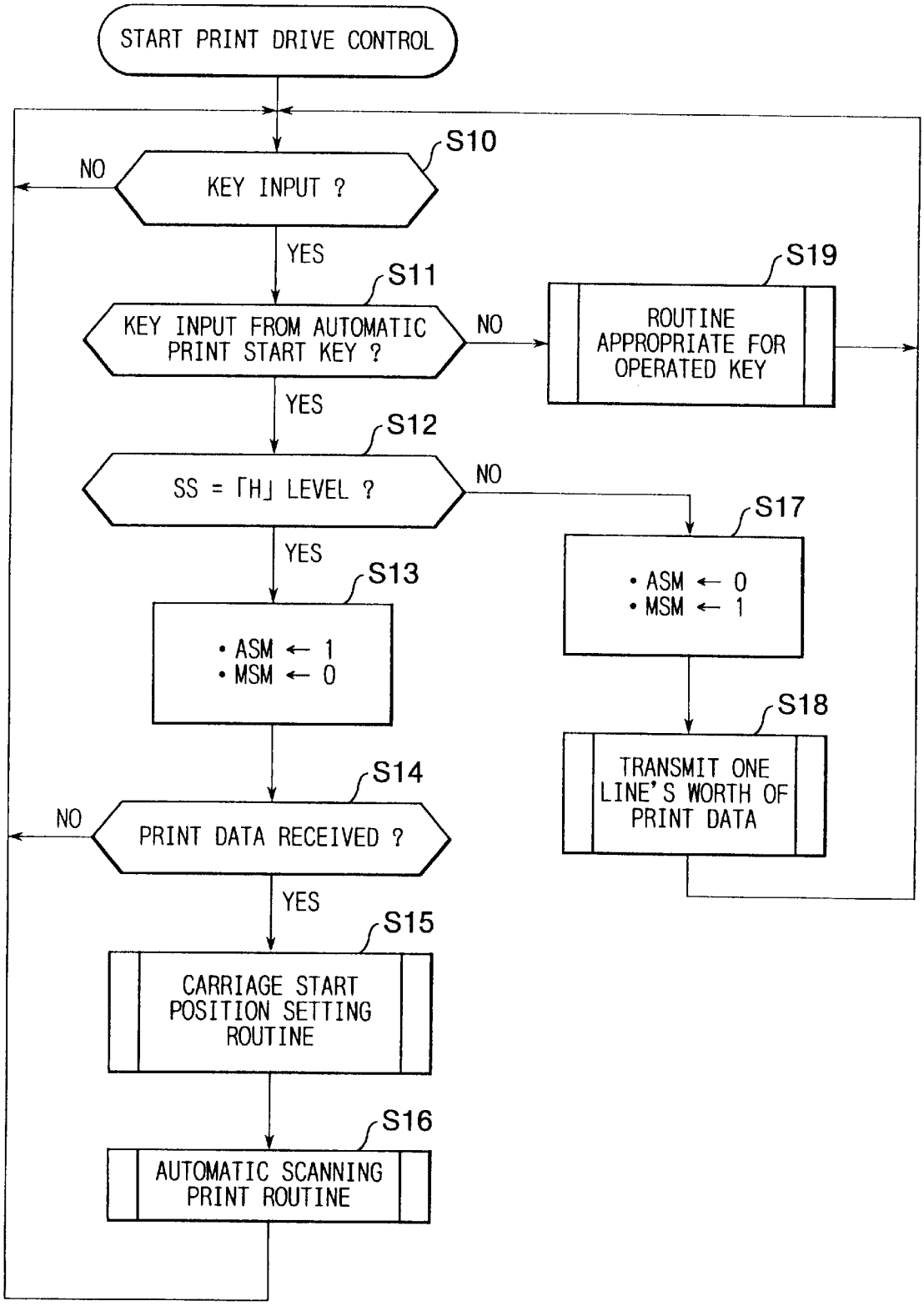
FIG. 15 is a flowchart representing a print drive control performed by the control system shown in FIG. 10.
Figure 16:
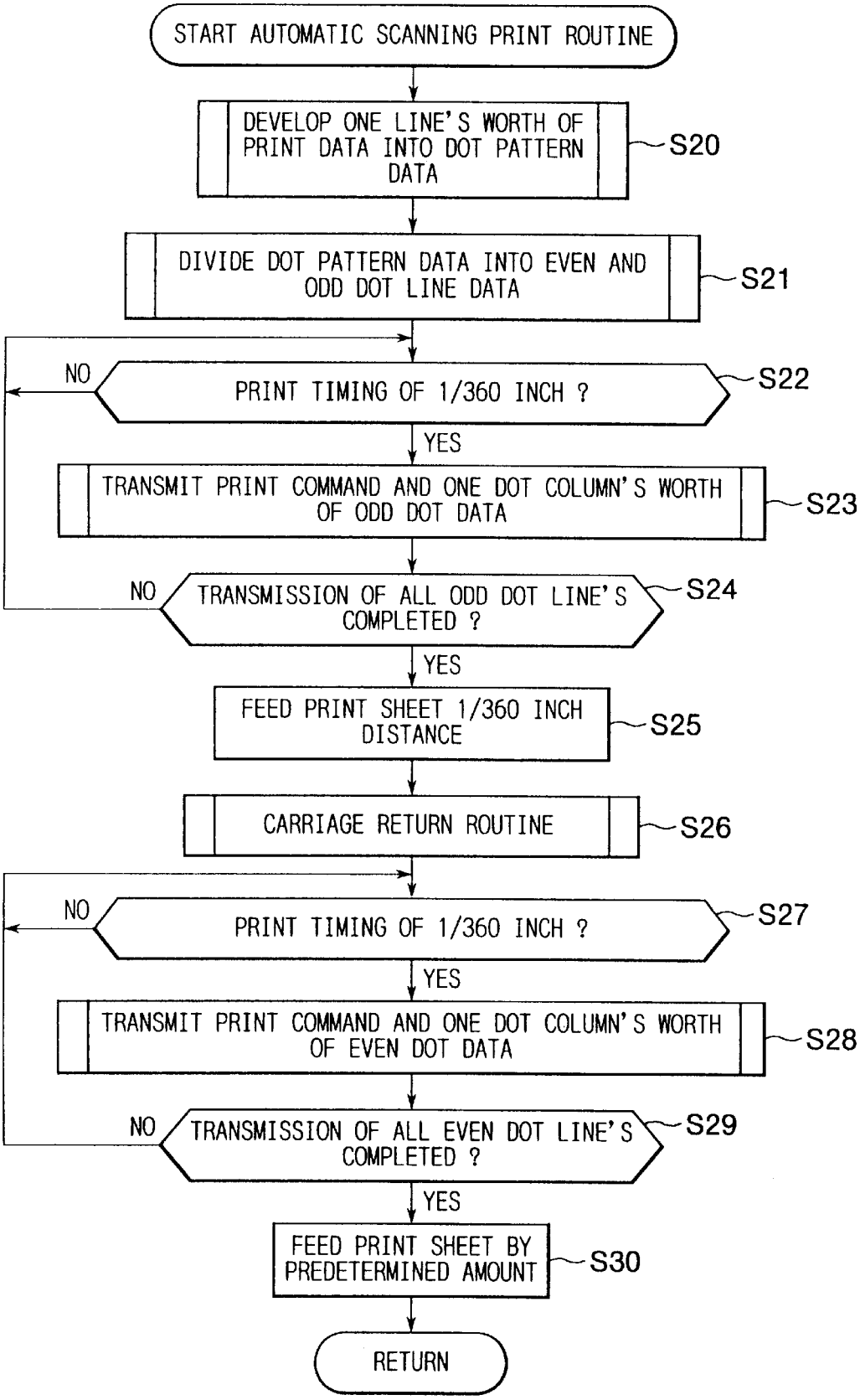
FIG. 16 is a flowchart representing an automatic scanning print routine performed by the control system shown in FIG. 10.

Next, a print drive control routine performed by the control unit 50 of the printing device 1 will be explained based on flowcharts in FIGS. 15 and 16 wherein Si (i=10, 11, 12 . . . ) represents individual steps. To facilitate explanation, it will be assumed that the image to be printed is a pure black image wherein all nozzles are fired at each print timing.

This control routine starts when a power switch of the operation panel is turned on. When a key other than an automatic printing start key is operated (S10:YES, S11:NO), a process corresponding to the operated key is executed in S19 and then the program returns to S10. When the automatic printing start key is operated (S10, 11:YES), a mounting signal SS from the mounting condition detection sensor 61 is retrieved. When the mounting signal SS is at "H" level, which indicates that the printing unit 70 is mounted on the carriage 21 (S12:YES), then in S13, an automatic scanning mode ASM is set to "1" and also a manual scanning mode MSM is reset to "0".

Next, upon receiving print data from the external electric device 64 (S14:YES), then in S15, a process is executed to set the carriage 21 in a start position. In this process, the carriage drive motor 19 is driven to move the carriage 21 in a reciprocal return direction, which is opposite a reciprocal forward direction, of the main scanning direction until the start position sensor 60 outputs a start position signal. Then, in S16, an automatic scanning print routine shown in FIG. 16 is executed for controlling sheet feed simultaneously with controlling movement of the carriage and printing.

When this routine is started, first in S20, each set of code data representing characters and symbols included in one line's worth of print data is developed into dot pattern data divided into 128 dot by 128 dot squares, that is, that extend 128 dots in both the sheet-feed direction and the main scanning direction. Then in S21, based on the dot pattern data, a dividing process is executed for dividing the dot pattern data into 64 lines' worth of odd dot lines of dot pattern data and 64 lines' worth of even dot lines of dot pattern data. In other words, two line's worth, i.e. an odd line and an even line, of dot pattern data is prepared for each nozzle of the print head 82. Then, the carriage drive motor 19 drives the carriage 21 to move in the main scanning direction. Next, in S22, based on the number of drive steps outputted to the carriage drive motor 19, whether or not the carriage 21 has been driven a distance of 1/360 inches from the print starting position is determined. Once the carriage 21 has been driven 1/360 inches from the print starting position (S22:YES), then in S23, a print command signal and one dot column's worth of the dot data from the 64 lines' worth of odd dot pattern data, that is, dot data for driving all the nozzles to each eject one droplet, is outputted and transmitted to the printing unit 70.

Next, when data for all 64 lines' worth of odd dot lines has not yet been transmitted (S24:NO), then S22 though S24 are repeated to a print column of odd dot print data at a print timing of each 1/360 inches until all the 64 line's word of odd dot lines have been printed. When transmission has been completed, i.e., all odd dot lines have been printed (S24:YES), then in S25, the print sheet 38 is fed by 1/360 inches and further in S26, a return process is executed for returning the carriage 21 to the print start position. While the carriage 21 is returning to the start position, at a print timing of every 1/360 inches (S27:YES), in S28, a print command signal and one dot column's worth of dot data for 64 lines'worth of even dot lines of dot pattern data is outputted and transmitted to the printing unit 70. When data for all even dot lines has been transmitted (S29:YES), then in S30, the print sheet 38 is fed by a predetermined amount. Although not shown in the drawings, the automatic scanning print routine is repeated to print further lines of dot pattern data in order to print over the entire print sheet 38. This completes the control routine and the program returns to S10 of the print drive control.

Figure 17:
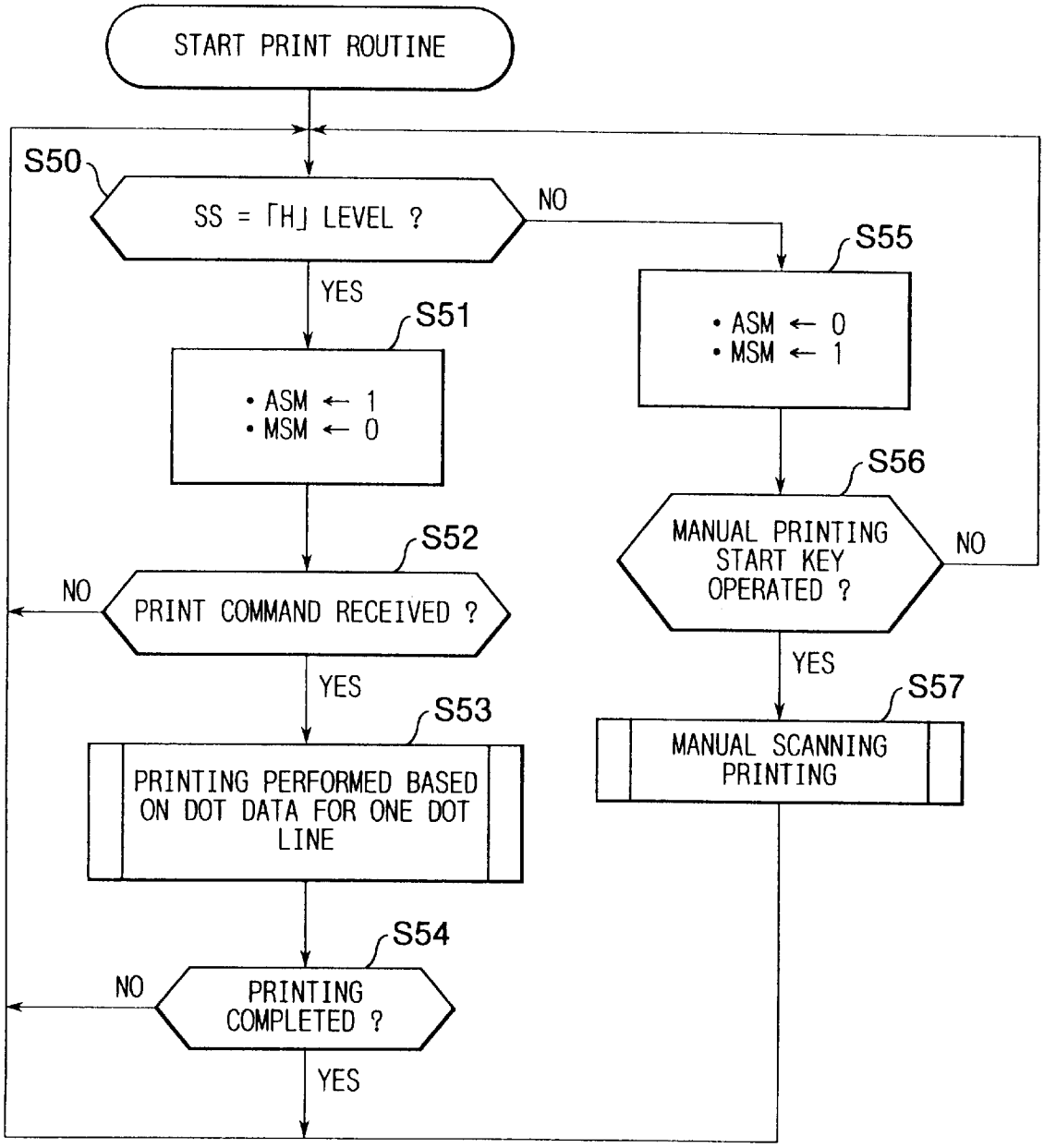
FIG. 17 is a flowchart representing a print routine performed by the control system shown in FIG. 14.

Next, a printing process control routine performed by the control unit 200 of the printing unit 70 will be explained while referring to the flowcharts in FIGS. 17 and 18.

This control routine starts when the power source switch 75*a* is turned on by operating the power source dial 75. First, a mounting signal SS from the mounting detection sensor 209 is retrieved. When the mounting signal SS is at "H" level, which means that the printing unit 70 is mounted on the carriage 21 (S50:YES), then in S51, the automatic scanning mode AMS is set to "1" and the manual scanning mode MSM is reset to "0".

When a print command signal is not received from the printing device 1 (S52:NO), then S50 through S52 are repeated. When a print command signal is received at a print timing corresponding to each 1/360 inches movement of the carriage 21 (S52:YES), then in S53, printing is performed by ejecting ink droplets from each ejecting nozzle n corresponding to the one dot line's worth of dot data received with the print command signal. When a print end order is not received (S54:NO), S50 through S54 are repeated. When the print end order is received (S54:YES), the program returns to S50.

Figure 19A:
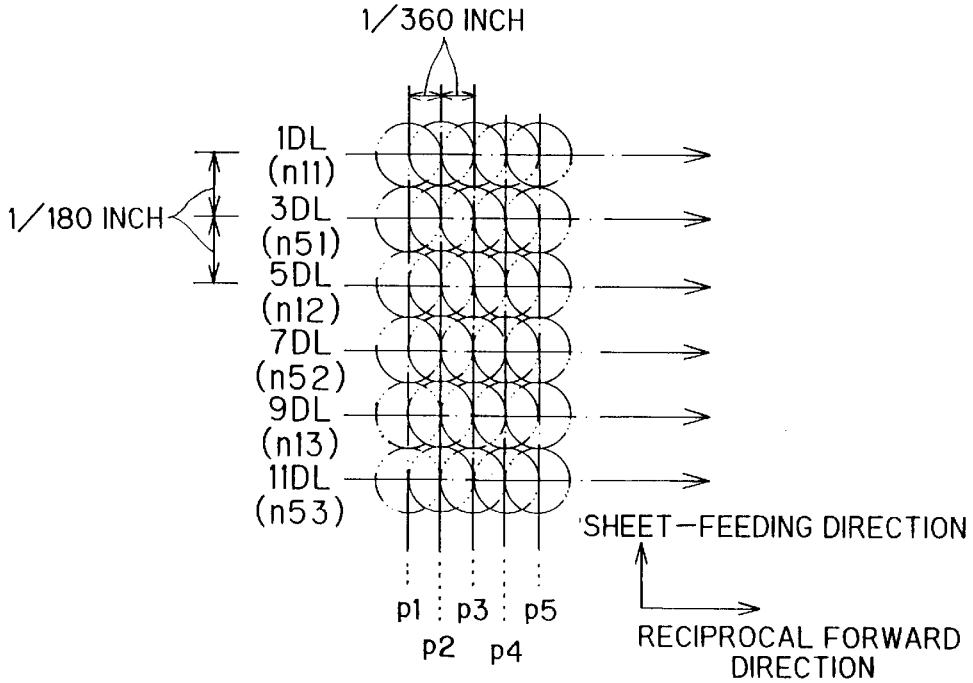
FIG. 19(*a*) is a schematic view showing a dot pattern produced by a single scan of the printing unit in a reciprocal forward direction during an automatic scanning mode.
Figure 19B:
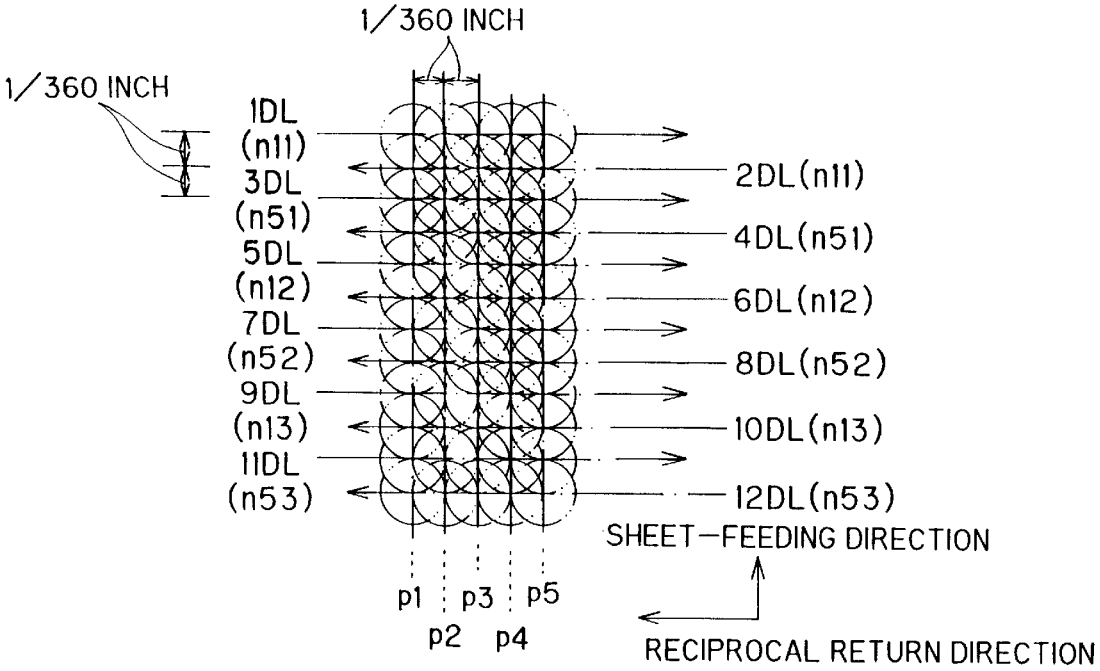

As mentioned previously, the first column 1L and the second column 2L of the print head 82 are separated by 1/90 inches. Therefore as shown in FIG. 19(*a*), in accordance with S20 through S26 of the automatic scanning printing process control shown in FIG. 16 and S50 through S54 of the printing routine shown in FIG. 17 and based on dot pattern data for odd dot lines 1DL, 5DL, 9DL . . . , ink is first ejected from the ejecting nozzles n51 through n82 of the second column 2L four times between a first print position p1, that is, the print start position, and a print position p4. That is, four columns of dots are printed, one at every print timing of 1/360 inches. Once the second column 2L reaches the next fifth print position 5p, then based on dot pattern data for odd dot lines 1DL, 3DL, 5DL . . . , every time the carriage 21 moves 1/360 inches, a column of ink dots are ejected from both the ejecting nozzles n11 through n42 of the first column 1L and the ejecting nozzles n51 through n82 of the second column 2L.

After the printing unit 70 has been scanned across the print sheet 38 once, the print sheet 38 is fed by 1/360 inches. Then, in S27 through S30 of the automatic scanning printing process control routine, as shown in FIG. 19(*b*), based on dot pattern data for even dot lines 2DL, 4DL, 6DL . . . , printing is performed at each print position p1, p2, p3, p4 . . . according to dot data of each dot column. That is, printing can be performed at a print resolution of 360 DPI in both the main scanning direction and in the sheet-feed direction.

On the other hand, in the print drive control, when the mounting signal SS is at an "L" level, which means that the printing unit 70 is removed from the carriage 21 (S12:NO), then in S17, the automatic scanning mode ASM is reset to "0" and the manual scanning mode MSM is set to "1". Then in S18, one line's worth of print data is transmitted to the printing unit 70 and the program returns to S10.

In the print routine, when the mounting signal SS from the mounting detection sensor 209 is at an "L" level, which means that the printing unit 70 is removed from the carriage 21 (S50:NO), then in S55, the automatic scanning mode ASM is reset to "0" and the manual scanning mode MSM is set to "1".

Figure 18:
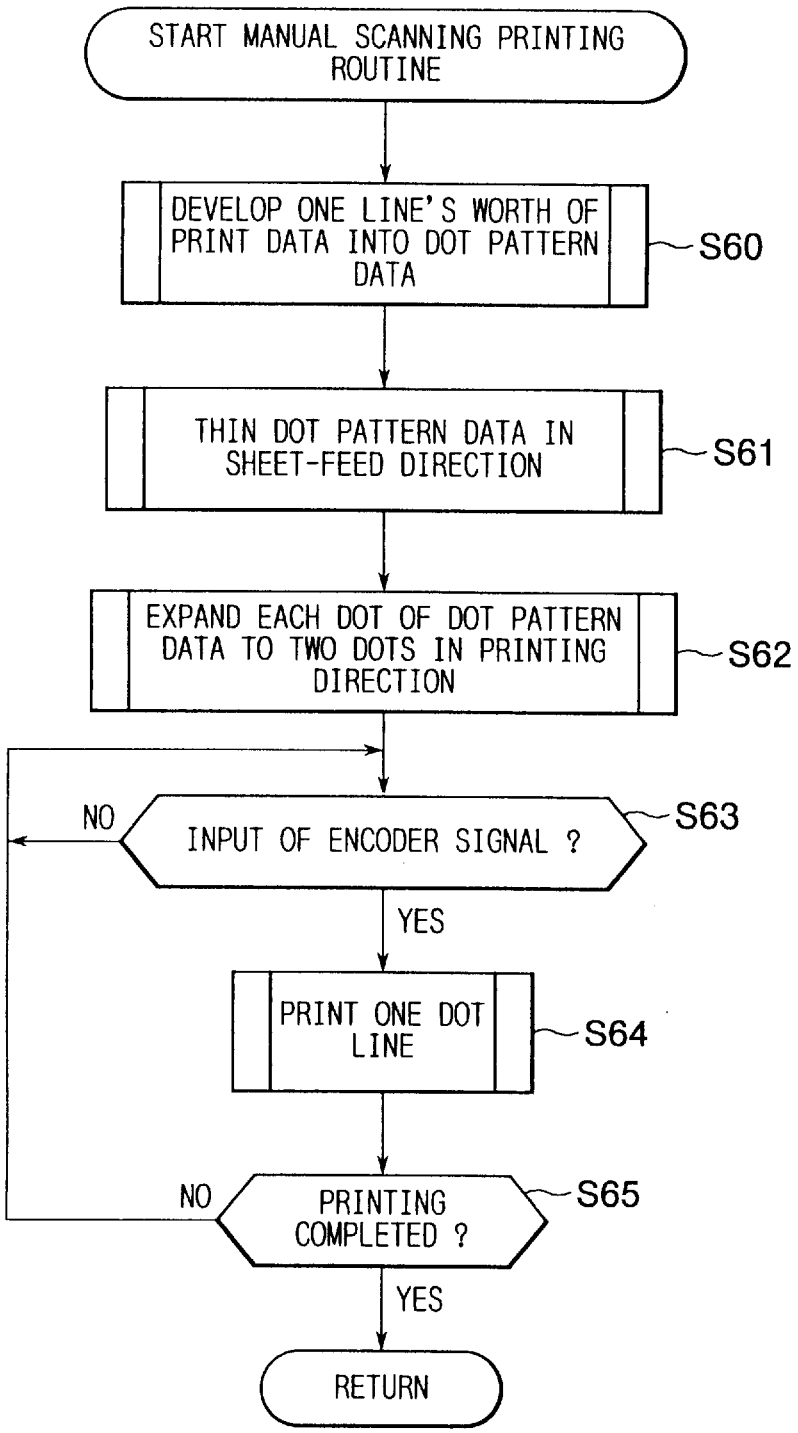
FIG. 18 is a flowchart representing a manual scanning printing routine performed by the control system shown in FIG. 14.

Next, when a manual printing start key is operated (S56:YES), then in S57, a manual scanning printing routine shown in FIG. 18 is executed.

When this control starts, first in S60, based on the print data transmitted to and stored in the RAM 203, a developing process is performed to develop each code data of characters and symbols included in one line's worth of print data into dot pattern data formed from 128 dots both in the sheet-feed direction and the main scanning direction. Next in S61, based on the dot pattern data, a thinning process is performed for thinning, in the auxiliary scanning direction, the even lines' of dot pattern data. Then in S62, an expanding process is performed for expanding the dot pattern data in the main scanning direction, by copying each dot of the dot pattern data into two dots.

In the present example, the dot patterns are thinned to half the number of dots in the sheet-feed direction and are doubled to twice the number of dots in the main scanning direction. In other words, dot pattern data corresponding to the two columns 1L and 2L, totaling 128 of ejecting nozzles n11 through n42 and n51 through n82, are thinned to produce a print resolution of 180 DPI, that is, dot pattern data for ejecting one dot per nozzle, or 128 dots, is thinned to eject one dot for every two nozzles, or 64 dots. On the other hand, the dot pattern data is expanded in the main scanning direction from 128 dots to 256 dots, that is, to a print resolution of 720 DPI.

To manually print, a user holds the body case 72, in a substantially upright posture so that the timing roller 91 contacts the print sheet 38. The user then manually moves the body case 72 straight in the main scanning direction. Every time the body case 72 is moved 1/720 inches, which corresponds to a print resolution of 720 DPI, rotation of the timing roller 91 causes the photosensor 97 to output an encoder signal accordingly. At this time (S63:YES), in S64 ink droplets are ejected from each ejecting nozzle n corresponding to one dot line's worth of dot data, so that printing is performed.

When the user continues printing (S65:NO), then S63 through S65 are repeated. When one line's worth of printing is completed by manual printing (S65:YES), this control ends and the program returns to S50 of the printing process.

Figure 20:
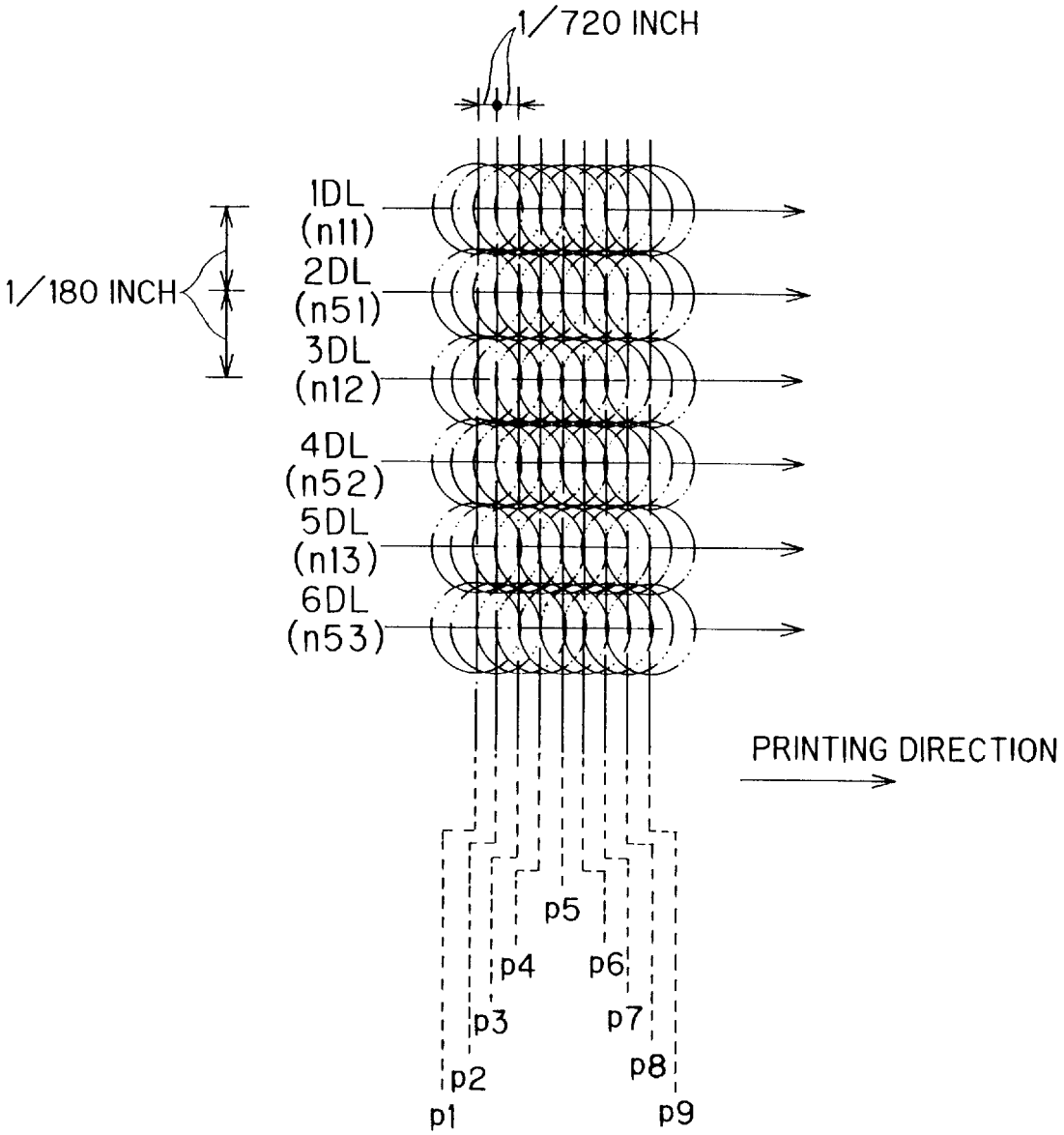
FIG. 20 is a schematic view showing a dot pattern produced by the printing unit during a manual scanning mode.
Figure 21:
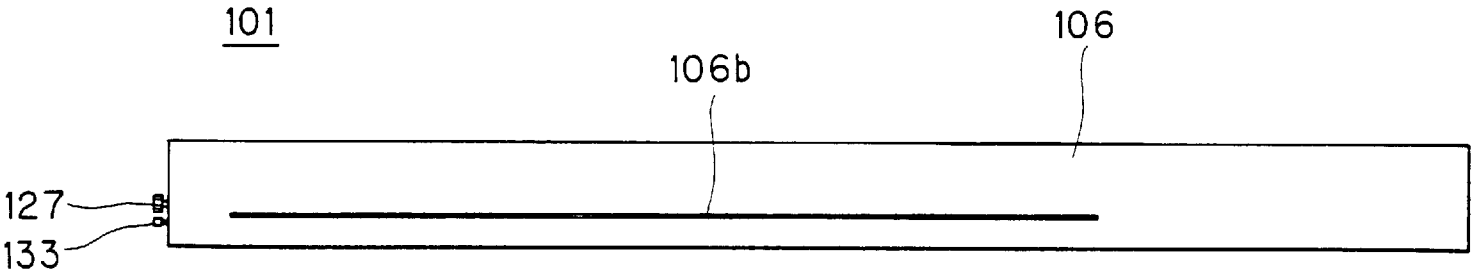
FIG. 21 is a longitudinal side view showing a printing device according to a second embodiment of the present invention.
Figure 22:
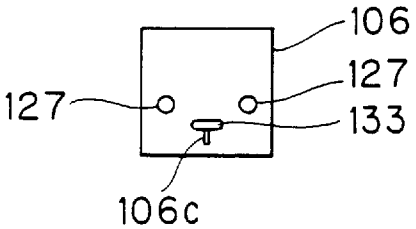
FIG. 22 is an end view showing the print device according to the second embodiment.
Figure 23:
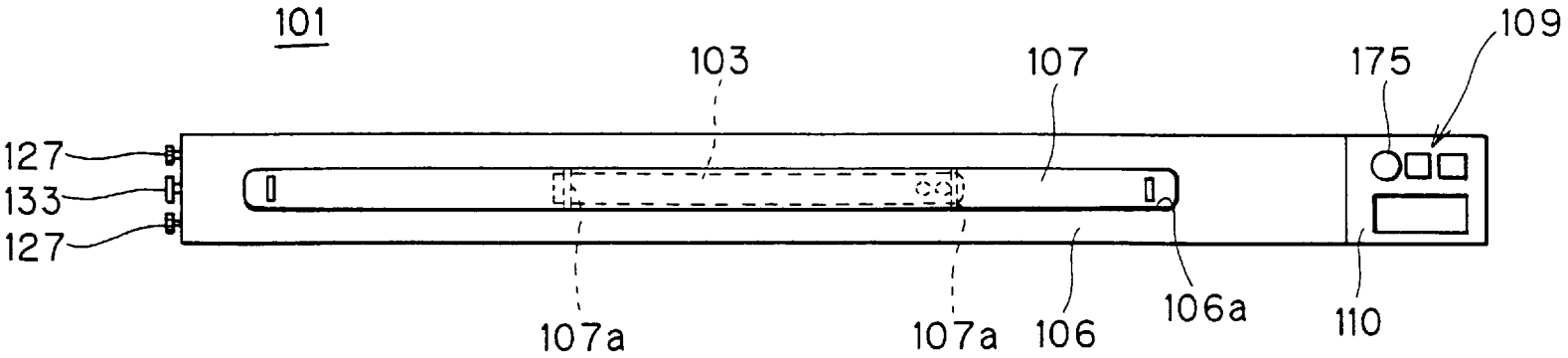
FIG. 23 is a plan view partially in phantom showing the print device according to the second embodiment with a lid covering an opening in the casing of the print device.
Figure 24:
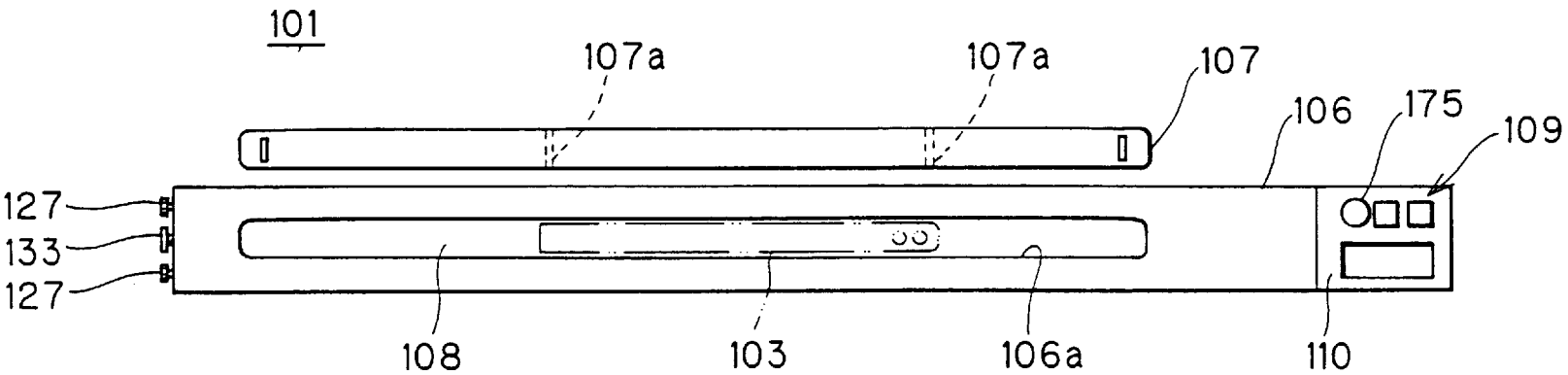
FIG. 24 is a plan view showing the print device according to the second embodiment with the lid removed.

As shown in FIG. 20, based on dot pattern data of each print dot line 1DL, 2DL, 3DL . . . , ink is ejected from the two columns 1L, 2L of ejecting nozzles nil through n42 and n51 through n82 starting at the print start position p1 and continuing to print at positions p2, p3, p4, p5 and the like each time as the body case 72 is moved a print pitch of 1/720 inches. In this way, single dot column's worth of dot data are printed one by one in series.

In other words, in the manual scanning mode, wherein printing is performed by removing the printing unit 70 from the carriage 21 and manually moving the body case 72 in the main scanning direction, printing is performed at the high print resolution of 720 DPI in the main scanning direction but at the lower print resolution of 180 DPI in the sheet-feed direction. Therefore, compared to printing in the automatic scanning mode shown in FIG. 19(*b*), the amount of ink ejected in the main scanning direction is doubled so that reduction in print density is reliably prevented.

As described above, the compact-sized printing device 1 includes the carriage movement mechanism 10 and the sheet-feed mechanism 30, both housed in the casing 2. The printing unit 70, which is detachably mounted on the carriage 21 of the carriage movement mechanism 10, includes the ink-jet type print head 82 and the movement amount detecting mechanism 90. Further, the mounting condition detection sensor 61 is provided to the carriage 21 and the mounting detection sensor 209 is provided to the printing unit 70 so that whether or not the printing unit 70 is mounted on the carriage 21 is detected using these detection sensors 61, 209.

With the printing device 1 having the above-described configuration, when it is detected that the printing unit 70 is mounted on the carriage 21, then the printing device 1 goes into its automatic scanning mode wherein printing is performed at the high print resolution of 360 DPI in both the print and sheet-feed directions.

On the other hand, when it is detected that the printing unit 70 is removed from the carriage 21, then the printing device 1 goes into its manual scanning mode wherein printing is performed at the print resolution of 180 DPI in the sheet-feed direction and at the high print resolution of 720 DPI in the main scanning direction. As a result, compared to the automatic scanning mode, ink ejection amount in the main scanning direction can be doubled so that reduction in print density is reliably prevented.

Further, because the print resolution in the main scanning direction in the manual scanning mode is the maximum resolution of the encoder plate 96 provided to the printing unit 70, the print resolution in the main scanning direction in the manual scanning mode can be easily changed by merely changing the maximum resolution of the encoder plate 96.

Also, when the printing unit 70 is mounted on the carriage 21 so that the printing device 1 is in its automatic scanning mode, the sheet-feed mechanism 30 is controlled in synchronization with the print control of the carriage movement mechanism 10 and the printing mechanism 80 to increase resolution in the main scanning direction by scanning the printing mechanism 80 in the main scanning direction more times than during the manual print mode. Therefore, printing is performed for multiple times while the print sheet 38 is transported in the sheet-feed direction by a predetermined minute amount, thereby increasing the print resolution in the sheet-feed direction.

Next, an explanation will be provided for configuration of a portable printing device 101 according to a second embodiment of the present invention. The configuration of the portable printing device 101 of the second embodiment is similar to the configuration of the portable printing device 1 of the first embodiment.

Figure 36:
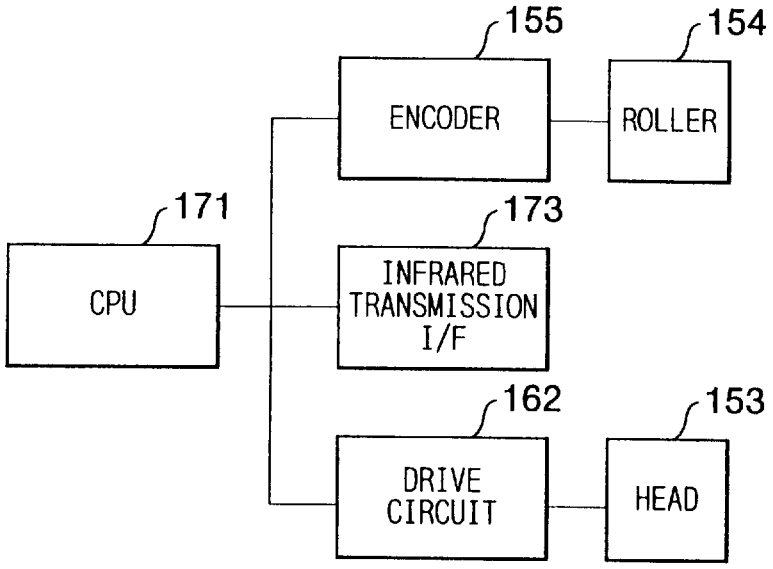
FIG. 36 is a block diagram showing a control system of the printing unit of FIG. 34.

FIGS. 21 through 24 are views showing the outside of the portable printing device. FIGS. 25 through 32 are cross-sectional views showing the internal configuration of the portable printing device. A portable printing device 101 includes: a narrow and long cylindrical casing 106; a transport mechanism 102 for transporting a print sheet; and a carriage movement mechanism 105. The casing 106 houses the transport mechanism 102 and the carriage movement mechanism 105. The carriage movement mechanism 105 is for reciprocally moving a carriage 104, by an amount depending in the size of the print sheet, in a direction substantially perpendicular to a sheet-transport direction. A unit detection sensor 66, shown in FIG. 36, is disposed to the carriage 104 to detect whether the printing unit 103 is mounted on the carriage 104, in which case the printing unit 103 is supported substantially perpendicular to the surface of the print sheet transported by the transport mechanism 102.

A narrow and long opening portion 106*a* is formed in the upper surface of the casing 106 so as to follow a movement area of the carriage 104. A lid body 107*a* detachably covers the opening portion 106*a*. Clip-shaped support portions 107*a*, 107*a* for detachably supporting the printing unit 103 are formed to the lid body 107*a*. Therefore, when the lid body 107*a* covers the opening portion 106*a*, the printing unit 103 is housed in a space portion 108 formed following the movement pathway of the carriage 104 in the casing 106.

Another lid body 110 is detachably provided to the end portion of the casing 106. The lid body 110 is formed with an operation key portion 109 having a print start switch and the like. The operation key portion 109 is for controlling the transport mechanism 102 and the carriage movement mechanism 105 to perform printing. A battery 120 is also provided at the end portion in the casing 106. An optical window portion 175, to be described later, for using infrared light to perform transmission between the printing unit 103 and an external portable information processor (not shown in the drawings) is formed to the outside of the casing 106.

Figure 25:
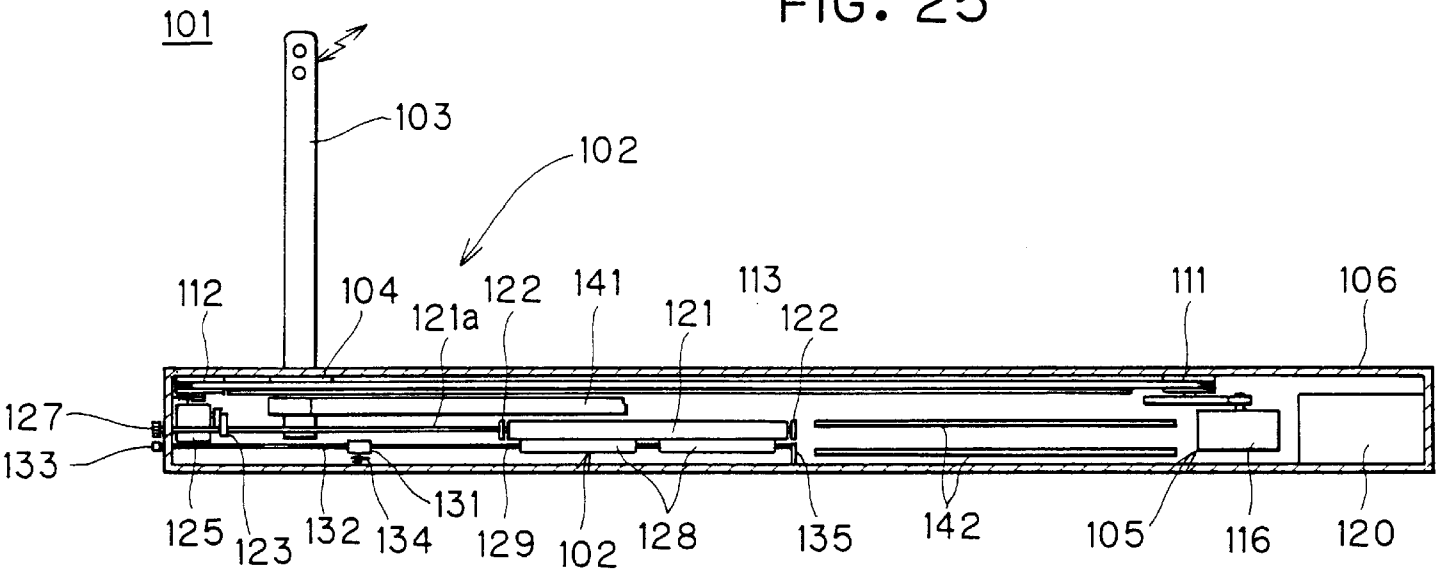
FIG. 25 is a cross-sectional side view showing the print device according to the second embodiment.
Figure 26:
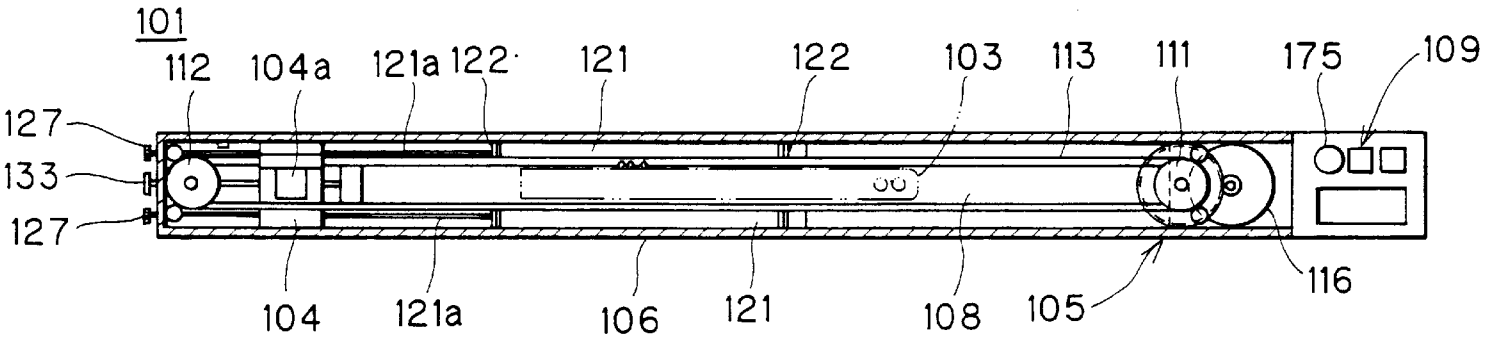
FIG. 26 is a cross-sectional plan view showing the print device according to the second embodiment.
Figure 27:
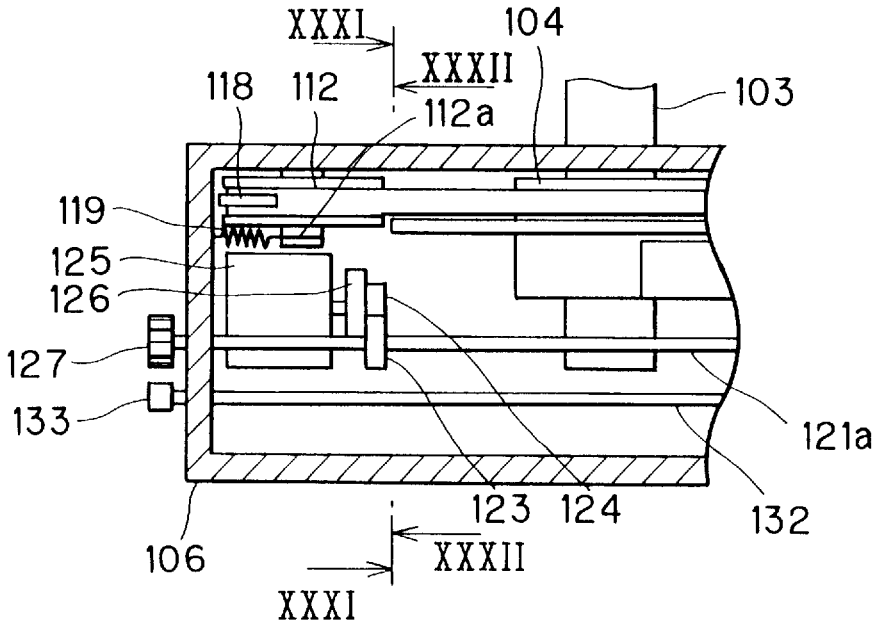
FIG. 27 is a detail of FIG. 25 showing a left end, as viewed in FIG. 25, of the print device according to the second embodiment.
Figure 29:
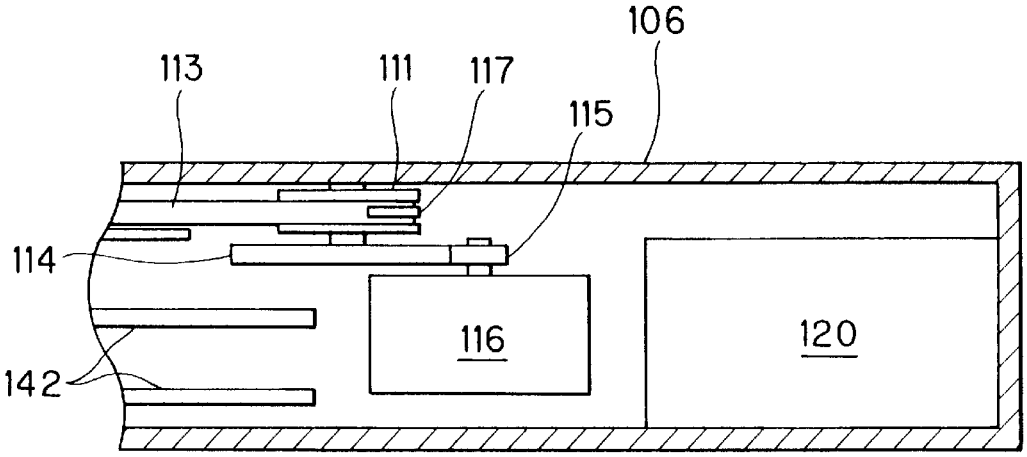
FIG. 29 is a detail of FIG. 25 showing a right end, as viewed in FIG. 25, of the print device according to the second embodiment.

As shown in detail in FIG. 25, the carriage movement mechanism 105 includes: a drive pulley 111 rotatably supported on a side of the casing 106; a following pulley 112 rotatably supported on the other side of the casing 106; and a timing belt 113 spanning between the pulleys 111 and 112 and fixed to a fixing portion 104*b* of the carriage 104. As best seen in FIG. 29, the carriage movement mechanism also includes a pulley gear 114 integrally formed with the drive pulley 111; a drive gear 115 meshingly engaging with the pulley gear 114; and a pulse motor 116 for driving the drive gear 115 to rotate in forward and reverse directions. As best seen in FIG. 20, diameters of the drive pulley 111 and the following pulley 112 are set larger than the width of the printing unit 103 so that the space portion 108 for housing the printing unit 103 is formed in a narrow, elongated area encompassed by the timing belt 113.

Figure 32:
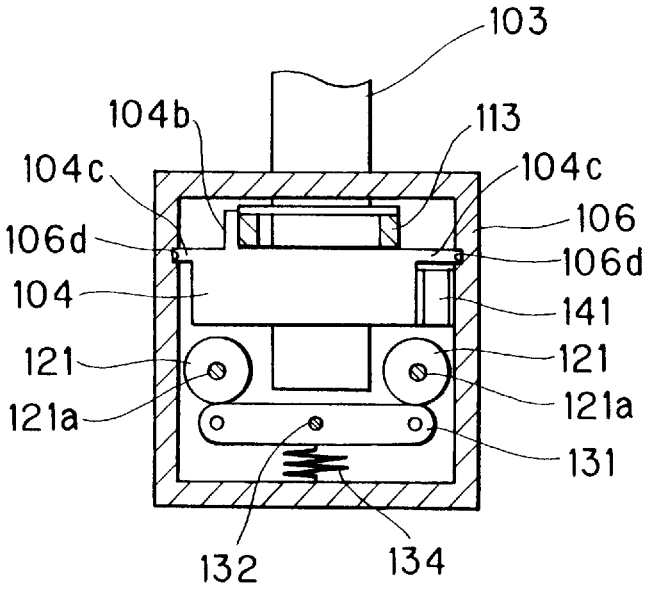
FIG. 32 is a cross-sectional view taken along line XXXII—XXXII of FIG. 27.

As shown in FIG. 32, engagement portions 104*c*, 104*c* are provided for slidably engaging with guide grooves 106*d*, 106*d* of the casing 106 so that the carriage movement mechanism 105 can smoothly transport the carriage 104.

Figure 28:
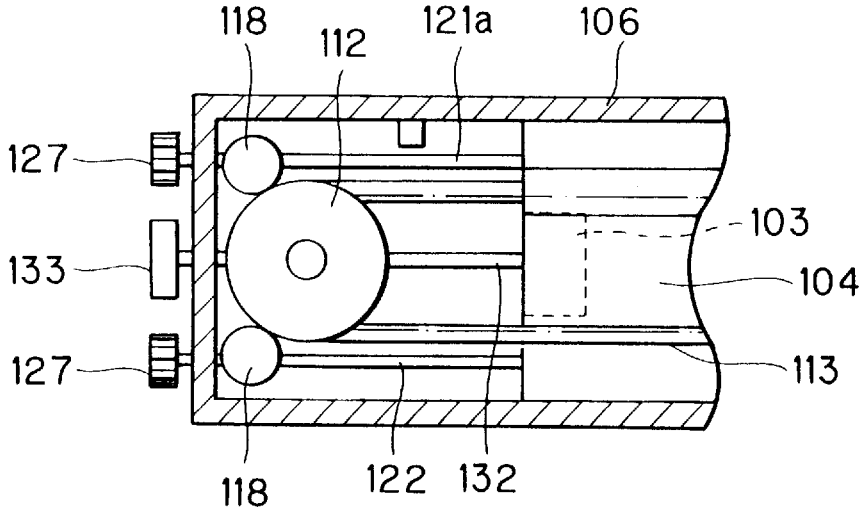
FIG. 28 is a detail of FIG. 26 showing a left end, as viewed in FIG. 26, of the print device according to the second embodiment.
Figure 30:
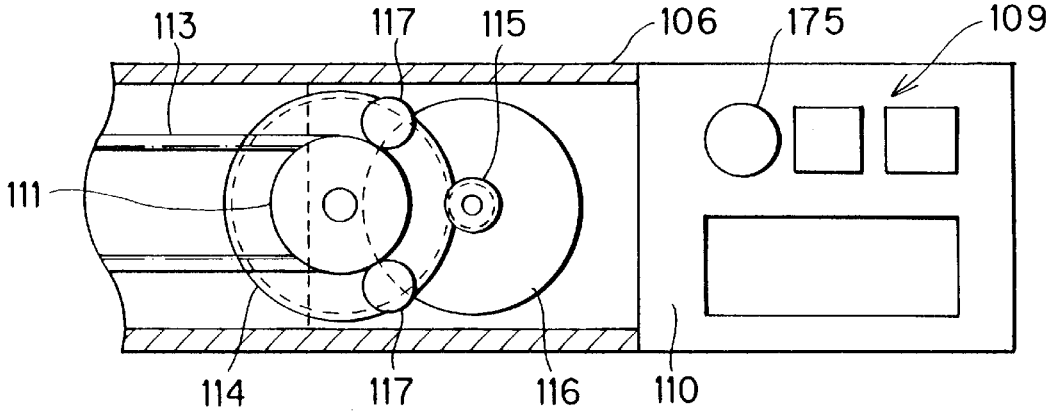
FIG. 30 is a detail of FIG. 26 showing a right end, as viewed in FIG. 26, of the print device according to the second embodiment.
Figure 31:
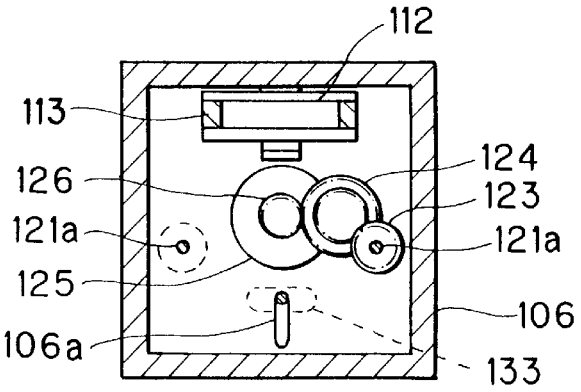
FIG. 31 is a cross-sectional view taken along line XXXI—XXXI of FIG. 27.

As best seen in FIGS. 28 and 30, supplemental pulleys 117, 118 are rotatably supported on the pulleys 111, 112 respectively. The supplemental pulleys 117, 118 rotatably contact the back surface of the timing belt 113, thereby preventing the timing belt 113 from derailing off the pulleys 111, 112.

Although not shown in the drawings, the following pulley 112 is supported on the casing 106 so as to be movable in its axial direction. A spring 119 extending between a spring holding portion 112*a* of the following pulley 112 and the casing 106 constantly urges the following pulley 112 away from the drive pulley 111, thereby maintaining tension of the timing belt 113.

As shown in FIG. 25, the transport mechanism 102 is disposed in the left side of the casing 106. The transport mechanism 102 transports a print sheet supplied through a sheet-supply port 106*b*, formed on the side surface of the casing 106, in a direction perpendicular to a reciprocal movement direction of the carriage 104. After the printing unit 103 mounted on the carriage 104 finishes printing, the print sheet is discharged from a sheet-discharge port (not shown in the drawings).

More specifically, as shown in FIGS. 25 to 27 and 30 to 32, the transport mechanism 102 includes transport rollers 121 and supplemental rollers 128, 128. The transport rollers 121 and the supplemental rollers 128, 128 are for transporting print sheets sandwiched therebetween and are positioned slightly on the left side of the casing so as to be positioned at the center of print sheets to be transported thereby.

Rotational shafts 121*a* rotatably supported on the casing 106 via bearings 122, 122 support the transport rollers 121. A gear 123 is fixed to each of the rotational shafts. A pulse motor 125 disposed at the left side of the casing 106 is provided with a drive gear 126 mounted on its drive shaft and in connection with one of the gears 125 via an idle gear 124. Although not shown in the drawings, another idle gear is provided for connecting rotation of the other of the gears 125 to rotation of the drive gear 126. The left-most tips of both the rotational shafts 121*a* protrude from the casing 106. A roller rotation knob 127 for manually rotating the transport roller 121 is fixed to the protruding tip of each of the rotational shafts 121*a*.

The supplemental rollers 128, 128 are rotatably supported on rotational shafts 129, 129. The rotational shafts 129, 129 are rotatably supported on a bearing 135 at one end and on a connecting member 131 at the other end. A shaft member 132 is also connected to the connecting member 131 at one end and extends away from the rotational shafts 129, 129. At the other end of the shaft member 132, a push-down lever 133 is fixed so as to protrude outward through an elongated hole 106*c* of the casing 106. By pushing the push-down lever 133 down, the supplemental rollers 128, 128 separate from the transport rollers 121, thereby making it easy to insert a print sheet therebetween.

A coil spring 134 spans between the connecting member 131 and the casing 106. The coil spring 134 constantly urges the supplemental rollers 128, 128 so as to contact the transport roller 121.

A flexible substrate 141 is disposed substantially in parallel with the movement course of the carriage 104. Base plates 142, 142 are disposed in parallel with each other between the pulse motor 116 and the transport mechanism 102.

Figure 33:
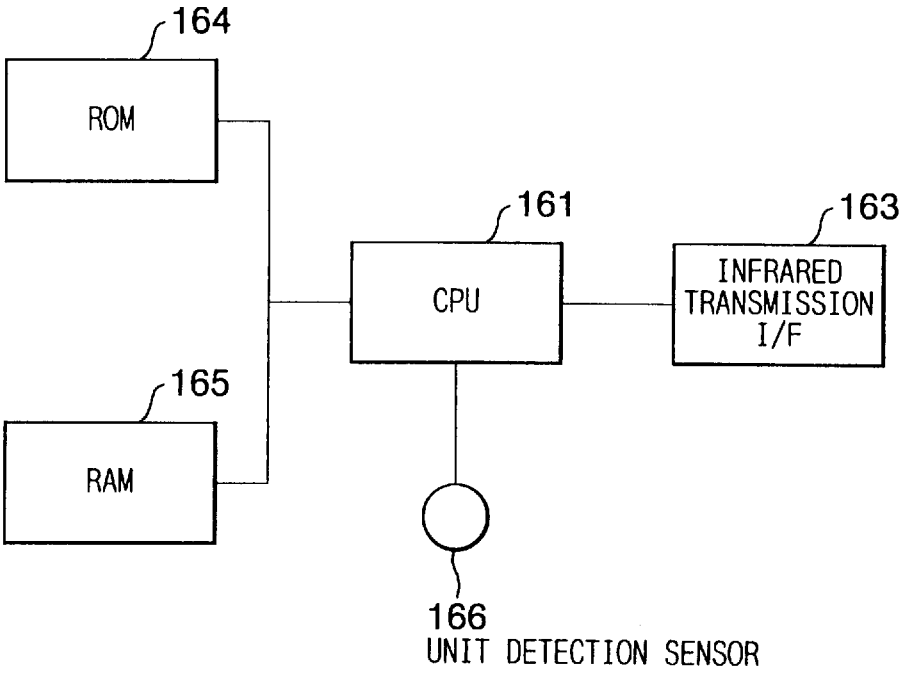
FIG. 33 is a block diagram showing a control system housed in a casing of the print device according to the second embodiment.

A control portion (not shown in the drawings) housed in the casing 106 is configured, for example, as shown in FIG. 33. A ROM 164 stores a control program for printing and the like. A RAM 165 temporarily stores print data and the like. As mentioned previously, the unit detection sensor 166, for detecting whether or not the printing unit 103 is mounted on the carriage 104, is provided on the carriage 104. An infrared transmission interface 163 transmits print data between an external device and the portable printing device 101, and one dot line's worth of dot data between the portable printing device 101 and the printing unit 103.

Figure 34:
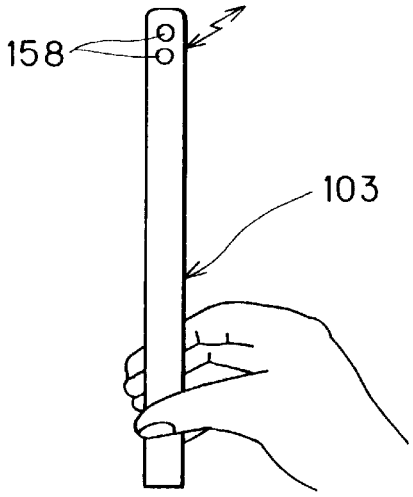
FIG. 34 is a perspective view showing a printing unit of the print device according to the second embodiment.
Figure 35:
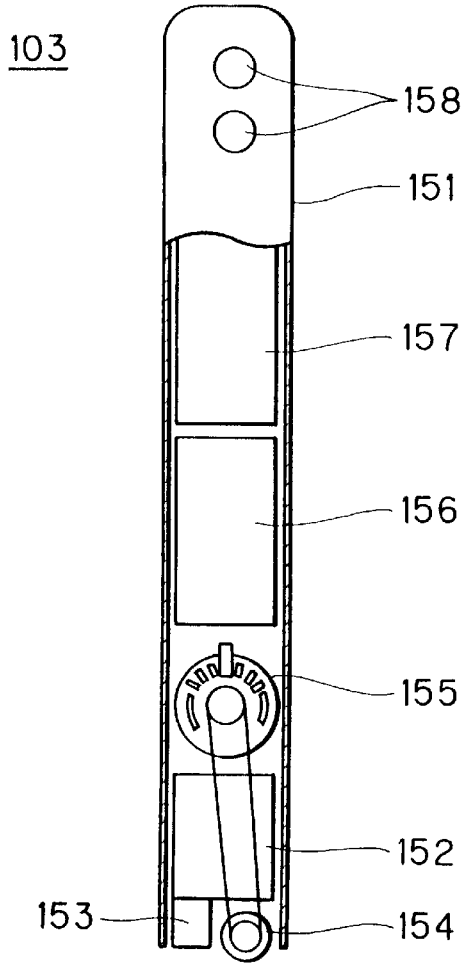
FIG. 35 is a side view in partial cross-section showing the printing unit of FIG. 34.

The printing unit 103 shown in FIG. 34 is formed to substantially a four-sided pillar shape. As shown in FIG. 35, the printing unit 103 includes in its casing 151: a print head 153 connected with an internal ink tank 152; a head movement amount detection unit 155 formed from a rotatable roller 154, an encoder 155 detecting rotational amount of the roller 154, and the like for detecting relative movement amount between the print head 153 and the print medium; a battery 156 serving as a power source; and a drive control portion 157 receiving signals from the head movement amount detection means 155 and controlling drive timing of the print head 153 accordingly. When a user holds the printing unit 103 by hand and scans it across a print sheet, printing can be performed solely with the printing unit 103.

An optical window 158 for using infrared light to transmit signals to the infrared transmission interface 163 in the casing is formed on the upper portion of the casing 151. One dot line's worth of dot data is directly transmitted to the printing unit 103 through the optical window 158. However, when the printing unit 103 is mounted on the carriage 104, dot data can be transmitted to the printing unit 103 via the carriage 104. For example, a data transmission connector can be provided to the carriage 104 for performing wired transmission or a data transmission device can be provided to the carriage for performing wireless transmission.

As shown in detail in FIG. 36, the drive control portion 157 includes the encoder 155 and the roller 154, and also a CPU 171, a drive circuit 162 for driving the head 153, and an infrared transmission interface 173. A rotational amount of the roller 154 is detected by the encoder 155 and inputted, as a head movement amount, to the CPU 171. Based on the head movement amount, drive timing of the print head 153 is controlled via the drive circuit 162. The infrared transmission interface 173 uses infrared light to transmit and receive signals to and from the infrared transmission interface 163 in the casing 106.

Next, operations of the portable printing device 101 will be explained. A user can either print manually using the printing unit 103 alone by holding the printing unit 103 by hand, or automatically by mounting the printing unit 103 on the carriage 104. Processes for printing are represented by the flowchart shown in FIG. 37.

When printing is started, in S101, in order to determine if printing is to be manually or automatically performed, whether or not the printing unit 103 is mounted in the opening portion 104*a* of the carriage 104 is determined by confirming the detection signal from the unit detection sensor 166.

When the printing unit 103 is mounted on the carriage 104 (S101:YES), printing will be performed automatically. Therefore, whether or not a print start switch (not shown in the drawings) of the operation key portion 109 is pressed is determined in S102. When the print start switch is not pressed (S102:NO), printing can not be started so that S102 is repeated until the print start switch is pressed. It should be noted that at this time, the row of ink jet nozzles of the print head 53 is positioned in parallel with a sheet-feed direction of the print sheet.

On the other hand, when the print start switch is pressed (S102:YES), then in S103, whether or not any print data remains unprinted is determined. When no print data remains (S103:NO), then all print data has been printed so that printing is completed. When printing data remains (S103:YES), in S104, one dot line's worth of dot pattern data is transmitted to the printing unit 103 from a print buffer of the RAM 65, in the case casing 106, whereupon dot pattern data necessary for performing one line's worth of printing is stored in a memory of the printing unit 103. Then in S105, the pulse motor 116 is driven by one step to move the carriage 104. It should be noted that completion of printing is determined based on whether or not dot pattern data is left in the print buffer.

In S106, the printing unit 103 ejects ink and performs printing for one dot line. Then in S107, whether or not one line's worth of printing has been completed is determined.

When one line's worth of printing has been completed (S107:YES), in S108, the pulse motor 116 rotates backward and returns the carriage 104 to the start position, and then the next one line's worth of dot pattern data is transmitted to the print buffer. In S109, the pulse motor 125 drives the transport roller 121 to rotate for a predetermined amount, thereby feeding the print sheet a fixed amount. Then, the program returns to S103. On the other hand, when one line's worth of printing has not been completed (S107:NO), the program returns to S104.

When the printing unit 103 is mounted on the carriage 104 (S101:NO), it is determined that printing will be performed using only the printing unit 103. Therefore, whether or not the encoder 155 is rotated is determined in S110. When the encoder 155 is rotated (S110:YES), this means that the roller 154 is being rotated to start printing. Whether or not print data is completed is determined in S111. On the other hand, when the encoder 155 is not rotated (S110:NO), S110 is repeated.

When no print data remains unprinted (S111:NO), it means that all print data has been printed so that printing has been completed. When printing has not been completed (S111:NO), in S112, one dot line's worth of dot pattern data is transmitted to the printing unit 103 from a print buffer in the casing 106. Then in S113, the printing unit 103 ejects ink to print one dot line. After that, the program returns to S110 where whether or not the encoder 155 is rotating is determined.

With the above-described configuration, the printing unit 103 is stored in the space portion 108 formed along a movement pathway of the carriage 104 in the casing 106. Therefore, the printing unit 103 can be effectively stored using this unused space so that the printing unit 103 will not be lost while being carried around. Because the carriage 104 is transported by the timing belt 113, the space portion 108 encompassed with the timing belt 113 will inevitably be generated. Because the printing unit 103 is stored in the space portion 108, this dead space can be effectively used. Additionally, the support portions 107*a*, 107*a* of the lid body 107 detachably support the printing unit 103 so that the printing unit 103 can be easily stored in the space portion 108, thereby facilitating attachment and detachment of the printing unit 103.

The infrared transmission interface 163 receives print data from an external portable information process device. Based on the print data, printing can be performed either manually using only the printing unit 103, or automatically by mounting the printing unit 103 on the carriage 104 and using the transport mechanism 102 and the carriage movement mechanism 105. Therefore, the present invention can be used both for manual printing and automatic printing according to objectives of the user. Printing can be performed manually, for example, on a thick notebook or writing pad, on which printing can not be performed automatically.

Figure 38:
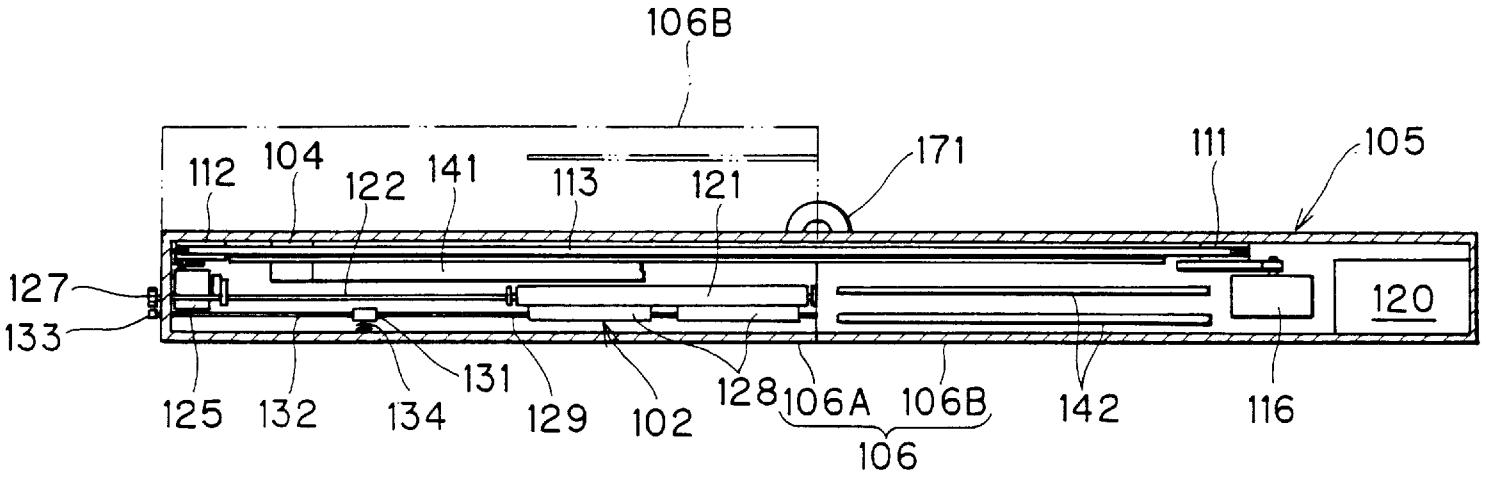
FIG. 38 is a cross-sectional view showing a modification of the print device of the second embodiment.

In the second embodiment, the length of the casing 106 is longer than that of a print sheet so that it is slightly inconvenient to be carried. Here, an explanation will be provided for a modification of the second embodiment, wherein the casing can be folded in half as shown in FIG. 38.

In this case, the casing 106 is divided at its center into left and right casing members 106A, 106B. Hinge members 171, 171 foldably connect the casing members 106A, 106B so that the casing 106 can be folded in half or opened up straight. One portion of the carriage movement mechanism 105 is housed in the casing member 106A and the other portion is stored in the casing member 106B. The carriage movement mechanism 105 is capable of moving the carriage 104 when the casing 106 is opened up. The casing 106 is folded in half for transport. At this time, the printing unit 103 is stored, similar to the situation described in the second embodiment, along the movement pathway of the carriage 104 encompassed with the timing belt 113 in one or the other of the casing members 106A or 106B. Caps and the like for holding the printing unit 103 in place can be attached to the tip portions of the casing members 106A, 106B.

While the invention has been described in detail with reference to specific embodiments thereof, it would be apparent to those skilled in the art that various changes and modifications may be made therein without departing from the spirit of the invention, the scope of which is defined by the attached claims.

For example, with respect to the configuration of the first embodiment, the print resolution in the main scanning direction in the manual scanning mode can be increased with respect to the print resolution in the automatic scanning mode. Reduction in print density can be also prevented in this case.

A voltage change control can be provided for setting drive voltage supplied to the print head 82 higher in the manual scanning mode than that in the automatic scanning mode. In this case, even when the print resolution in the sheet-feed direction is low, the volume of each dot ejected on the print sheet 38 will be increased, so that the print density will be extremely high.

Although a belt or a wire is used to transport the print medium in the above-described embodiments, a rack and pinion mechanism can be used instead.

Also, in the first and second embodiments, an infrared transmission interface for transmitting with an external portable information process device (external device) using infrared light is provided in the casing. However, the infrared transmission interface can be provided in the printing unit instead. In this case, a control device including a ROM, a RAM, and a unit detection sensor would need to be provided in the printing unit. Also, the external device and the casing or the external device and the printing unit can be electrically connected by wiring at more than one position.

In short, the present invention can be applied to any portable printing device wherein a printing unit having a print head is freely detachably mounted on a carriage in a casing so that the printing unit can be used as a normal page printer, that is, when the printing unit is mounted on the carriage, or as a portable pen type printer, that is, when the printing unit alone is used for printing.

The present invention can further be applied to a thermal printing device having a thermal head for printing using an ink ribbon, or to a printing device detachably mounted with various kinds of printing units, such as ones having image retrieval units.

Also, any configuration described in the first embodiment can be applied to the printing device of the second embodiment and vice versa.

What is claimed is:

1. A printing device for printing images and the like on a print medium, the printing device comprising:

a relative movement unit including a carriage, the relative movement unit generating relative movement between the carriage and the print medium in a main scanning direction and in an auxiliary scanning direction perpendicular to the main scanning direction;

a printing unit detachably attached to the carriage and having a print head capable of printing dot patterns on the print medium while the printing unit is attached to the carriage and while the printing unit is detached from the carriage; and a detection unit for detecting whether the printing unit is attached to the carriage.

2. A printing device as claimed in claim 1, wherein the relative movement unit includes:

a print medium feed unit that feeds the print medium in the auxiliary scanning direction;

a carriage transport unit that reciprocally moves the carriage in the main scanning direction; and a casing that houses the print medium feed unit and the carriage transport unit.

3. A printing device as claimed in claim 2, wherein the printing device is put into an automatic scanning mode when the detection unit detects that the printing unit is mounted on the carriage and into a manual scanning mode when the detection unit detects that the printing unit is not mounted on the carriage.

4. A printing device as claimed in claim 3, further comprising a control unit that, when the printing device is in the automatic scanning mode, controls the print medium feed unit in synchronization with the carriage transport unit and the printing unit to increase print resolution in the auxiliary scanning direction compared with print resolution in the auxiliary scanning direction during the manual print mode.

5. A printing device as claimed in claim 4, wherein to increase print resolution in the auxiliary scanning direction during the automatic scanning mode, the control unit controls the carriage transport unit to reciprocally move the printing unit more times during the automatic scanning mode than required to print during the manual scanning mode.

6. A printing device as claimed in claim 5, wherein to increase print resolution in the auxiliary scanning direction during the automatic scanning mode, the control unit controls the print medium feed unit to feed the print medium at shorter distances during the automatic scanning mode than a distance across a print medium for printing by an operator during the manual scanning mode.

7. A printing device as claimed in claim 6, wherein to increase print resolution in the auxiliary scanning direction during the automatic scanning mode, the control unit controls the printing unit to print data more often during the automatic scanning mode than required during the manual scanning mode.

8. A printing device as claimed in claim 2, wherein the casing is formed with a hollow portion extending in a movement path of the carriage to a size capable of housing the printing unit.

9. A printing device as claimed in claim 8, wherein the casing is formed with an opening portion following the carriage movement path, the printing device further comprising a detachable lid detachably covering the opening, the lid being formed with a support portion detachably supporting the printing unit.

10. A printing device as claimed in claim 8, wherein the carriage transport unit includes:

a drive pulley and a follower pulley disposed separated by a predetermined distance in the main scanning direction; and a belt fixed at a portion thereof to the carriage and wrapped around the drive pulley and the follower pulley;

wherein the hollow portion of the casing extends in the main scanning direction and is encompassed by the belt.

11. A printing device as claimed in claim 8, wherein the casing includes first and second members connected foldable between a folded condition and a linear condition.

12. A printing device as claimed in claim 1, wherein the printing device is put into an automatic scanning mode when the detection unit detects that the printing unit is mounted on the carriage and into a manual scanning mode when the detection unit detects that the printing unit is not mounted on the carriage.

13. A printing device as claimed in claim 12, further comprising a print timing control unit that controls print timing of the printing unit to print in the main scanning direction at a print resolution that depends on whether the printing device is in the automatic scanning mode or the manual scanning mode.

14. A printing device as claimed in claim 13, wherein the print timing control unit controls print timing of the printing unit to print in the main scanning direction at a higher print resolution in the manual scanning mode than in the automatic scanning mode.

15. A printing device as claimed in claim 14, wherein the printing unit is provided with a print timing detection encoder having a maximum encoder resolution, the print timing control unit controlling print timing of the printing unit to print during the manual scanning mode at a resolution in the main scanning direction based on the maximum encoder resolution.

16. A printing device as claimed in claim 14, wherein the print timing control unit controls print timing of the printing unit to print in the main scanning direction at a print resolution two times higher during the manual scanning mode than during the automatic scanning mode.

17. A printing device as claimed in claim 12, further comprising a voltage switching unit that switches drive voltage supplied to the print head to a higher drive voltage when the printing device is in the manual scanning mode than when the printing device is in the automatic scanning mode.

18. A printing device for printing images and the like on a print medium, the printing device comprising:

a print medium feed unit that feeds the print medium in an auxiliary scanning direction;

a carriage transport unit having a carriage and that reciprocally moves the carriage in a main scanning direction perpendicular to the auxiliary scanning direction;

a printing unit having a print head detachably mountable to the carriage and capable of printing on the print medium while mounted on said carriage and while detached from said carriage; and a casing that houses the print medium feed unit and the carriage transport unit, the casing formed with a hollow portion extending in a movement path of the carriage to a size capable of housing the printing unit.

19. A printing device as claimed in claim 18, wherein the carriage transport unit moves the carriage in an amount corresponding to a size of the print medium.

20. A printing device as claimed in claim 18, wherein the casing is formed with an opening portion following the carriage movement path, the printing device further comprising a detachable lid detachably covering the opening, the lid being formed with a support portion detachably supporting the printing unit.

21. A printing device as claimed in claim 18, wherein the carriage transport unit includes:

a drive pulley and a follower pulley disposed separated by a predetermined distance in the main scanning direction; and a belt fixed at a portion thereof to the carriage and wrapped around the drive pulley and the follower pulley;

wherein the hollow portion of the casing extends in the main scanning direction and is encompassed by the belt.

22. A printing device as claimed in claim 18, wherein the casing includes first and second members connected foldable between a folded condition and a linear condition.

23. A printing device as claimed in claim 22, wherein a first portion of the carriage transport unit is housed in the first member and a second portion of the carriage transport unit is housed in the second member, the carriage transport unit being brought into an operable condition, wherein it can move the carriage, when the casing is in the linear condition.

24. A printing device as claimed in claim 18, wherein the printing unit includes a transmission portion for receiving print data from an external device.

* * * * *